US008475300B2

(12) United States Patent
Ueda

(10) Patent No.: US 8,475,300 B2
(45) Date of Patent: Jul. 2, 2013

(54) METHOD OF EVALUATING A GOLF CLUB

(75) Inventor: Masahiko Ueda, Kobe (JP)

(73) Assignees: SRI Sports Limited, Kobe (JP); Sumitomo Rubber Industries, Ltd., Kobe (JP)

( * ) Notice: Subject to any disclaimer, the term of this patent is extended or adjusted under 35 U.S.C. 154(b) by 257 days.

(21) Appl. No.: 12/847,522

(22) Filed: Jul. 30, 2010

(65) Prior Publication Data

US 2011/0028248 A1 Feb. 3, 2011

(30) Foreign Application Priority Data

Jul. 31, 2009 (JP) ..... 2009-179729

(51) Int. Cl.
*A63B 69/38* (2006.01)

(52) U.S. Cl.
USPC ..... 473/409; 473/221; 473/269; 473/407

(58) Field of Classification Search
USPC ..... 473/221, 223, 269, 407, 409
See application file for complete search history.

(56) References Cited

U.S. PATENT DOCUMENTS

| | | | | |
|---|---|---|---|---|
| 5,772,522 | A * | 6/1998 | Nesbit et al. | 473/222 |
| 2006/0252018 | A1* | 11/2006 | Sooch | 434/252 |
| 2007/0105641 | A1 | 5/2007 | Ban | |
| 2008/0020867 | A1* | 1/2008 | Manwaring | 473/407 |
| 2008/0234065 | A1 | 9/2008 | Ban | |
| 2009/0062027 | A1* | 3/2009 | Sato | 473/221 |
| 2010/0267462 | A1* | 10/2010 | Mooney | 473/269 |

FOREIGN PATENT DOCUMENTS

| | | | |
|---|---|---|---|
| JP | 2000-202070 | A | 7/2000 |
| JP | 3735208 | B2 | 1/2006 |

OTHER PUBLICATIONS

Steven M. Nesbit and Monika Serrano, "Work and Power Analysis of the Golf Swing", Dec. 1, 2005, Journal of Sports Science and Medicine (2005), pp. 520-533.*

* cited by examiner

*Primary Examiner* — Arthur O. Hall
*Assistant Examiner* — Steve Rowland
(74) *Attorney, Agent, or Firm* — Birch, Stewart, Kolasch & Birch, LLP

(57) ABSTRACT

A method of evaluating a golf club is disclosed. The method includes a step (St1) of determining motions of the golf club during a swinging motion of a golf player including a period ranging from a time (Ts) to a time (Tf); a step (St2) of obtaining in a time series power index values (Pw) during the period ranging from the time (Ts) to the time (Tf), based on the result of the determination; a step (St3) of obtaining a power integration value (Sp) by integrating the power index values (Pw) during the period ranging from the time (Ts) to the time (Tf); a step (St4) of calculating club energy (Eg) of the golf club at the time (Tf); and a step (St5) of quantitatively evaluating club suitability based on the power integration value (Sp) and the club energy (Eg). Each of the power index values (Pw) is a value which is correlated to a power of a work provided from the golf player to the golf club.

17 Claims, 14 Drawing Sheets

METHOD OF EVALUATING A GOLF CLUB

The present invention claims priority of Japanese patent application No. 2009-179729 filed on Jul. 31, 2009. The entire disclosure in the Japanese application No. 2009-179729 is hereby incorporated by reference.

BACKGROUND OF THE INVENTION

1. Field of the Invention

The present application is related to a method of quantitatively evaluating a golf club.

2. Description of the Related Art

Generally, a golf player evaluates a golf club according to his/her sense (feeling). The evaluation of the golf club by the golf player is done in the form of questionnaire, for example. Based on the evaluation, it is judged if the golf player likes or dislikes the golf club. It is expected that the evaluation includes various factors such as: "easy to hit the golf ball", "easy to swing the golf club", "sense of hitting the golf ball" or the like. Such evaluation is done subjectively.

Senses of a human tend to vary depending on his/her physical condition, surroundings and so on. Hence, the result of the evaluation described above tends to vary depending on the physical condition of a testee, the surroundings of a test site and so on. Besides, the above evaluation is done in a qualitative manner only.

In these connection, JP 2007-130088 A (or US 2007/0105641 A1 or US 2008/0234065 A1 corresponding thereto) discloses a golf club having a relatively small primary moment and a relatively large secondary moment. In the embodiment therein, sensuous evaluation is done if a golfer feels easy to swing the golf club.

JP 3735208 B discloses an invention having an object of providing a golf club which is easy to swing in order to allow a golf player to keep a stable swinging motion. According to this prior invention, the golf club has a predetermined range with respect each to: an moment of inertia around a end of a grip (grip end); a length of a golf club; and a frequency of bending vibration of the golf club.

JP 2000-202070 A discloses an invention which may cope with difficulty of swinging an elongated (long) golf club. In this prior invention, a length of the golf club, a weight of the golf club, a moment of inertia of the golf club and so on are defined each in a predetermined range.

SUMMARY OF THE INVENTION

All of the conventional art discussed above is interested in ease of swinging a golf club. All of the above conventional art mentions a specification of the golf club which is considered as being easy to swing the golf club. In the conventional art, however, the evaluation is not done by the golf player in a quantitative manner. In particular, JP 2007-130088 A (or US 2007/0105641 A1 or US 2008/0234065 A1 corresponding thereto) only takes care of the sensuous evaluation. Both JP 3735208 B and JP 2000-202070 A do not even perform the sensuous evaluation.

An object of the present invention is, therefore, to provide a method of evaluating a golf club which allows quantitative evaluation of the golf club by the golf player.

The above object is fulfilled, according to a first aspect of the present invention as below:

A method of evaluating a golf club comprising the steps of:

a step (St1) of determining motions of the golf club during a swinging motion of a golf player including a period ranging from a time (Ts) to a time (Tf);

a step (St2) of obtaining power index values (Pw) in a time series during the period ranging from the time (Ts) to the time (Tf), based on the result of the determination;

a step (St3) of obtaining a power integration value (Sp) by integrating the power index values (Pw) during the period ranging from the time (Ts) to the time (Tf);

a step (St4) of calculating club energy (Eg) of the golf club at the time (Tf); and a step (St5) of quantitatively evaluating club suitability based on the power integration value (Sp) and the club energy (Eg);

wherein each of the power index values (Pw) is a value which is correlated to power of a work provided from the golf player to the golf club.

Preferably, the club suitability is evaluated based on a ratio (Sp/Eg) of the power integration value (Sp) relative to the club energy (Eg).

Preferably, the power index value (Pw) is calculated according to the Equation (1) as below:

$$Pw=M\cdot(\ddot{r}-g)\cdot\dot{r}+Tg\cdot\omega \quad (1)$$

where, in the equation (1), "M" is a weight of the golf club; "$\ddot{r}$" (with two dots appended thereto) is an acceleration of the center of gravity of the golf club; "g" is an acceleration of gravity; "$\dot{r}$" (with one dot appended thereto) is a velocity of the center of gravity of the golf club; "Tg" is a torque acting around a rotation axis (Z1) extending perpendicularly to a virtual swinging plane (PL1) and passing through the golf grip; and "ω" is an angular velocity of the golf grip.

Preferably, the club energy (Eg) is a sum of the values (E1) and (E2) as below:

(E1): kinetic energy of the golf club or an approximate value thereof; and (E2): rotation energy of the golf club or an approximate value thereof.

Preferably, the time (Tf) is a time when the golf club impacts on a golf ball.

Preferably, the time (Ts) is a time when the golf club is positioned adjacent a top-of-the-swing thereof.

Preferably, during the step (St1), the determination is effected with using a motion capturing system.

A further aspect of the evaluation method according to the present invention is as below:

A method of evaluating a golf club comprising the steps of:

a step (Stp1) of determining motions of the golf club during a swinging motion of a golf player at least one time (Tt1);

a step (Stp2) of obtaining a power index value (Pw) at least at one time (Tt2) during the swinging motion, based on the result of the determination a step (Stp3) of calculating club energy (Eg) of the golf club at the time (Tt2); and a step (Stp4) of quantitatively evaluating club suitability based on the power index value (Pw) and the club energy (Eg).

BRIEF DESCRIPTION OF THE DRAWINGS

—FIG. 6 shows an address and a taking-back motion;

—FIG. 7 shows a top-of-the-swing and a downswing;

—FIG. 8 shows the downswing and a impact;

—FIG. 9 shows a following-through motion and a finish;

DESCRIPTION OF THE PREFERRED EMBODIMENTS

Figure 1:
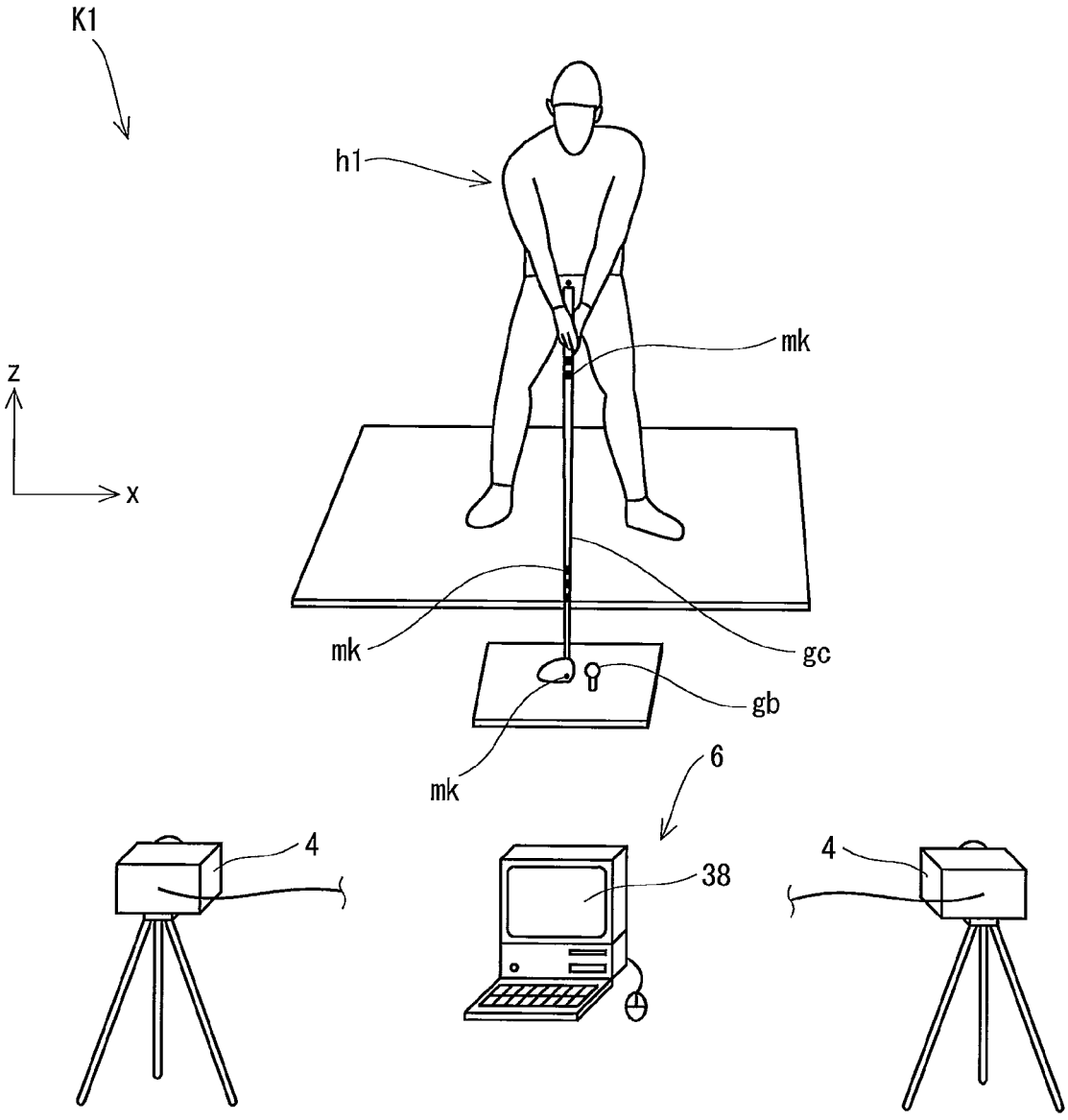
FIG. 1 is a view showing surroundings of determination according to one embodiment of the present invention.

The present invention will be described hereinafter in more detail based on preferred embodiments with reference to the accompanying drawings depending on necessity thereof.

According to the present embodiment, the evaluation of the golf club by a golf player can be quantitated. In other words, according to the present embodiment, suitability of a specified golf club to a specified golf player may be obtained in a quantitative value.

According to the present embodiment, motions of the golf club during a club swinging motion of the golf player are determined. In the present embodiment, based on the determination result of these motions, the power index value (Pw) at least at one time during the swinging motion is calculated. The power index value (Pw) can be correlated to power of a work provided from the golf player to the golf club.

In addition, in the present embodiment, the energy (Eg) of the golf club at least at one time during the swinging motion is calculated. In the present application, the energy (Eg) will be referred to as a club energy (Eg).

The club energy (Eg) is the energy which the golf player provided to the golf club. In the present embodiment, the club energy (Eg) and the power index value (Pw) determine the ease of swinging and other factors. In other words, the club energy (Eg) and the power index value (Pw) as described above determine the club suitability to that golf player.

The club energy (Eg) can be obtained in a numeric value. The power index value (Pw) can be obtained in a numeric value, too. Thus, the evaluation using the club energy (Eg) and the power index value (Pw) can be the quantitative evaluation. The quantitative evaluation can be objective evaluation. The objective evaluation is highly reliable.

The power index value (Pw) can be obtained at each time during the swinging motion. The club energy (Eg) can be obtained at each time during the swinging motion, too. Thus, various types of evaluation can be done depending on the data to be used among various times during the swinging motion. Instead, the data determined in the time series can be used, ranging from a certain time (Ts) to a further certain time (Tf). Detailed description thereof will be made later.

The determination method for calculating the power index value (Pw) will be described hereunder first.

The determination method of the motions of the golf club is not limitative, and thus various known determining methods can be used. For example, such a motion determination can be done based on images obtained by a video camera, consecutive photographs or the like.

The determination can be two-dimensional, or can be three-dimensional instead. Examples of the two-dimensional determination include a motion determination based on an image or images taken in front of the golf player, a motion determination based on an image or images taken behind a flying ball of the golf player and so on.

From the point of view of the determination precision, the three-dimensional determination is preferred for such a determination method.

One example of the preferred determination method should be using a known motion capturing system. With the motion capturing system, three-dimensional coordinates (x, y, z) of the markers can be determined in the time series. According to the motion capturing system, the three-dimensional coordinates are determined under a dynamic calibration method, or a static calibration method based on the triangulation law. The known motion capturing systems are operated under an optical method, a mechanical method, a magnetic method and so on, any one(s) of them can be employed. Further, a marker-less motion capturing system can be used, in which system no markers are necessary with using an image processing technique. When the swinging motion of the golf club is to be determined, however, the optical motion capturing system is more preferred, since this has a high degree of precision and the swinging motion of the testee is hardly bothered.

Figure 2:
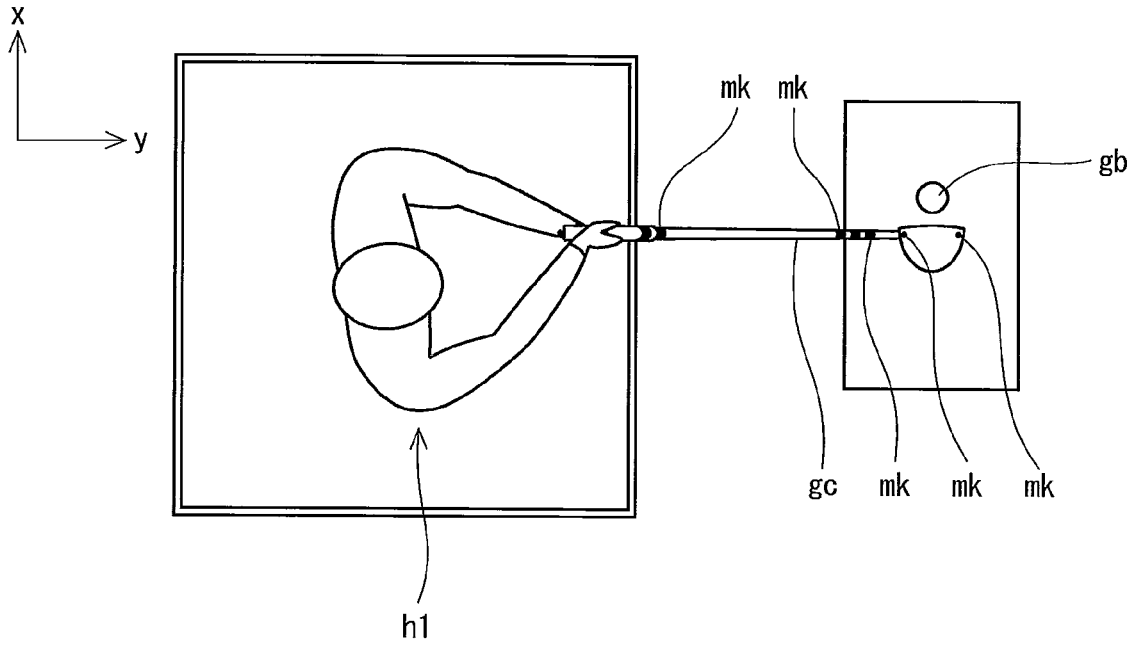
FIG. 2 is a view corresponding to FIG. 1 as seen from above.
Figure 3:
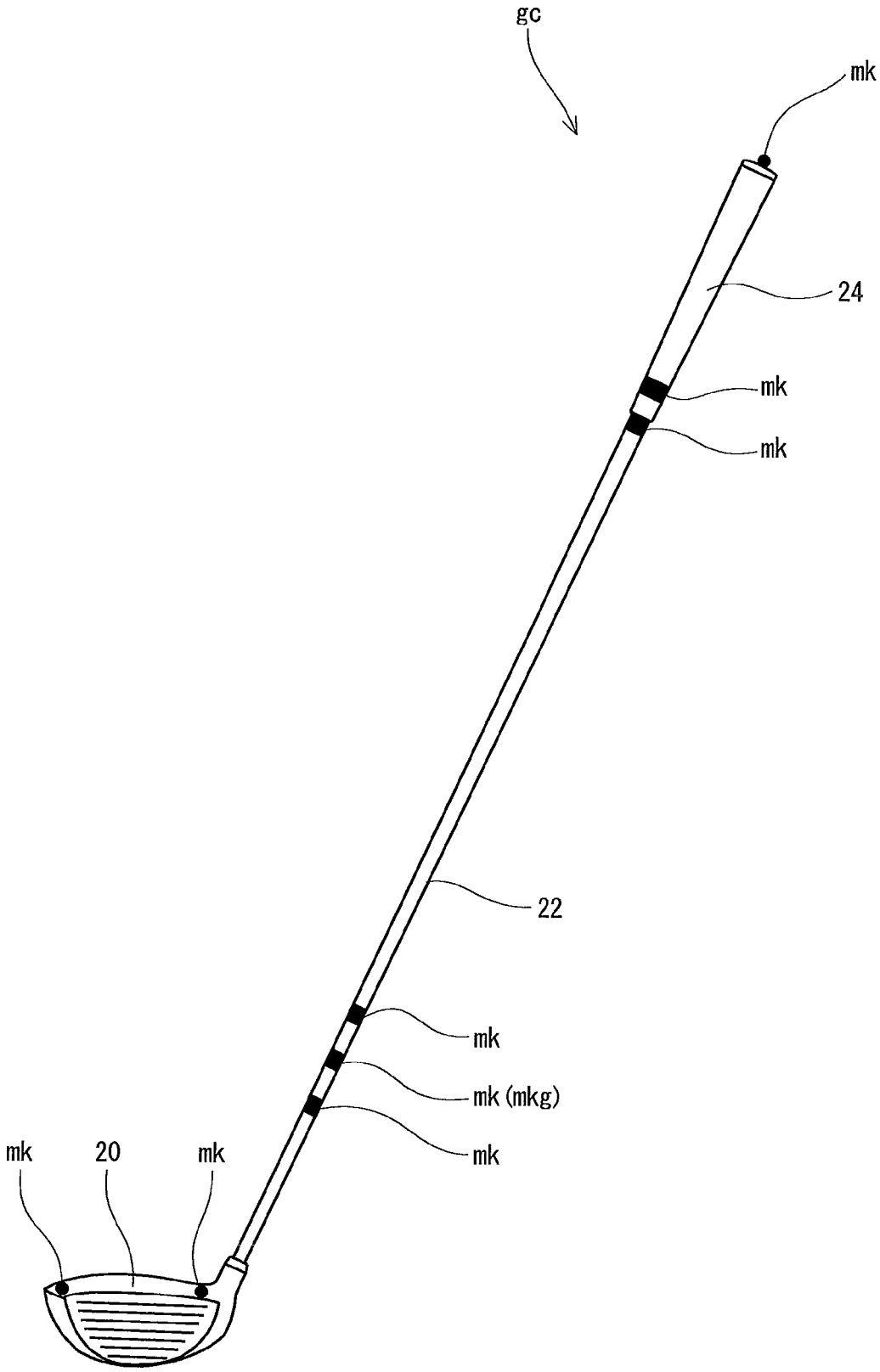
FIG. 3 is a view showing an entire golf club.

FIG. 1 is a view showing one embodiment of a swinging motion determination system (K1). FIG. 2 is a view corresponding to FIG. 1 as seen from above a testee (h1). In FIG. 1 and FIG. 2, in addition to the swinging motion determination system (K1), the testee (h1), a golf club (gc) and a golf ball (gb) are shown. FIG. 3 is a view showing the golf club (gc). It is assumed that the testee (h1) is a right handed golf player.

The determination is done at least at onetime (Tt1) during the swinging motion. The time (Tt1) is not limitative. The determination is preferably done between the time (Ts) during the swinging motion and the time (Tf) during the swinging motion. The time (Ts) is a time prior to the time (Tf). The time (Ts) is not limitative, and the time (Tf) is not limitative, either.

The determination from the time (Ts) to the time (Tf) is done in the time series. The time series data preferably mean by data determined at least three (3) times. More preferably, the time series data are a collection of the data determined and obtained at fixed intervals of times.

The determination can be done through an entire swinging motion, or through a part of the swinging motion. The entire swinging motion means by a period from a start of the swinging motion to an end (finish) of the swinging motion.

As described above, the swinging motion determination system (K1) is a motion capturing system. As shown in FIG. 1, the swinging motion determination system (K1) includes a plurality of cameras 4, markers (mk) mounted on the golf club (gc), and a data analyzing device 6.

The number of the cameras 4 is not limitative. From the point of view of obtaining the three-dimensional data, however, two or more cameras 4 are preferred. The plurality of cameras 4 is installed at positions different from one another. FIG. 1 only shows two cameras 4 in front of the testee (h1), but preferably another camera(s) is/are provided behind the testee (h1).

From the point of view of increasing the number of the times at which the determination can be done, at any and every time during the swinging motion, it is preferred that the images of all of the markers (mk) are taken by two or more cameras. The more there are the cameras, the higher the determination precision will be. From the points of view of these, the number of the cameras 4 is preferably no less than four, and more preferably no less than six. It is preferred that the plurality of the cameras 4 is arranged to surround the testee (h1). From the points of view of the cost of the devices and simplification of the calculation, the number of the cameras 4 is preferably no more than twenty, more preferably no more than fifteen and still more preferably no more than ten.

The type of the camera 4 is not limitative. For example, the type of the camera 4 can be an infrared camera, a color CCD (Charge Coupled Device) camera, or a monochrome CCD camera.

From the point of view of obtaining a still image of the highspeed swinging motion, it is preferred that a shutter speed of the camera 4 is preferably short. No more than 1/500 second is particularly preferred for the shutter speed.

When the shutter speed is short, an amount of light tends to become in short. To secure a necessary amount of light when using the CCD camera, an especially bright lighting device is necessary. When using an infrared camera, the markers (mk) can be taken even under the dark environment and with a short shutter speed. From the point of view of this, the infrared camera is more preferred. In this case, the markers (mk) are preferably highly reflective to the infrared.

The number of the markers (mk) mounted on the golf club (gc) is not limitative. From the point of view of calculation of angles of the shaft and so on, however, the number of the markers (mk) is preferably no less than two, and more preferably no less than three. However, if the number of the markers (mk) is extremely large, the weight of the markers (mk) becomes more influencing on the swinging motion, and sometimes affects the determination precision. From the point of view of this, the number of the markers (mk) is preferably no more than ten, and more preferably no more than eight.

As shown in FIG. 3, the golf club (gc) includes a head 20, a shaft 22 and a grip 24. In the embodiment as shown in FIG. 3, eight markers (mk) are provided. The markers (mk) are provided on the grip 24. More particularly, the markers (mk) are provided on a grip end. The markers (mk) are provided at least at two positions of the grip 24. The markers (mk) are provided on the shaft 22, too. More particularly, the markers (mk) are provided at least at two positions of the shaft 22. The markers (mk) are provided on the head 20, too. More particularly, the markers (mk) are provided at least at two positions of the head 20.

From the point of view of precisely determining a posture of the golf club (gc) or the shaft 22, it is preferred that the grip 24 has the markers (mk) at no less than two positions. From the point of view of precisely determining a posture of the golf club (gc) or the shaft 22, it is preferred that both of the grip 24 and the head 20 has the markers (mk) mounted thereon. From the point of view of precisely determining a posture of the shaft 22, it is preferred that the shaft 22 has the markers (mk) at no less than two positions. From the point of view of precisely determining a posture of the golf club (gc) or the shaft 22, it is preferred that the golf club (gc) has two markers (mk) provided on the golf club (gc) at a distance from each other no less than 30 mm. More preferably, the golf club (gc) has two markers (mk) provided on the golf club (gc) at a distance from each other no less than 50 mm. From the point of view of precisely determining the posture of the shaft 22, the golf club (gc) may has two markers (mk) provided on the shaft 22 at a distance from each other no less than 30 mm.

From the point of view of determining a posture of the shaft without an influence resulting from flexing of the shaft, it is preferred that the golf club (gc) has two markers (mk) provided on the grip 24 at a distance from each other no less than 200 mm.

From the point of view of determining a posture of the shaft without an influence resulting from flexing of the shaft, it is preferred that the markers (mk) are provided at least at two positions each from the grip end to a point apart from the grip end by 400 mm.

From the point of view of determining a speed of a center of gravity of the golf club (gc), the markers (mk) may be provided at the center of gravity of the golf club (gc) or in a vicinity thereof. Alternatively, the markers (mk) may be provided at the center of gravity of the golf club (gc) or at a distance no more than 5 cm from the center of gravity.

The shape of each marker (mk) is not limitative. For example, the shape of the marker (mk) may be a spherical shape, a semi-spherical shape or the like. Alternatively, the marker (mk) may be formed flat. For example, the marker (mk) may be in the form of a reflector tape or a painted mark.

It is to be noted that the markers (mk) can be omitted. Instead of the markers (mk), the golf club (gc) may have a mark or marks thereon. Such a mark is not limitative, so long as it may be captured as an image. For example, the shaft 22, the grip 24 and/or the head 20 may have the marks thereon. For example, each of such marks may be a color, a pattern, and a shape (protrusion or the like). It is preferred that the markers (mk) or the marks as described above can be captured by the infrared camera. The preferred positions of the marks are the same as those of the markers (mk).

As shown in FIG. 1, as the data analyzing device 6, a computer 30 is used. Two or more computers may be used. Incidentally, a hub (described later) is not illustrated in FIG. 1.

Figure 4:
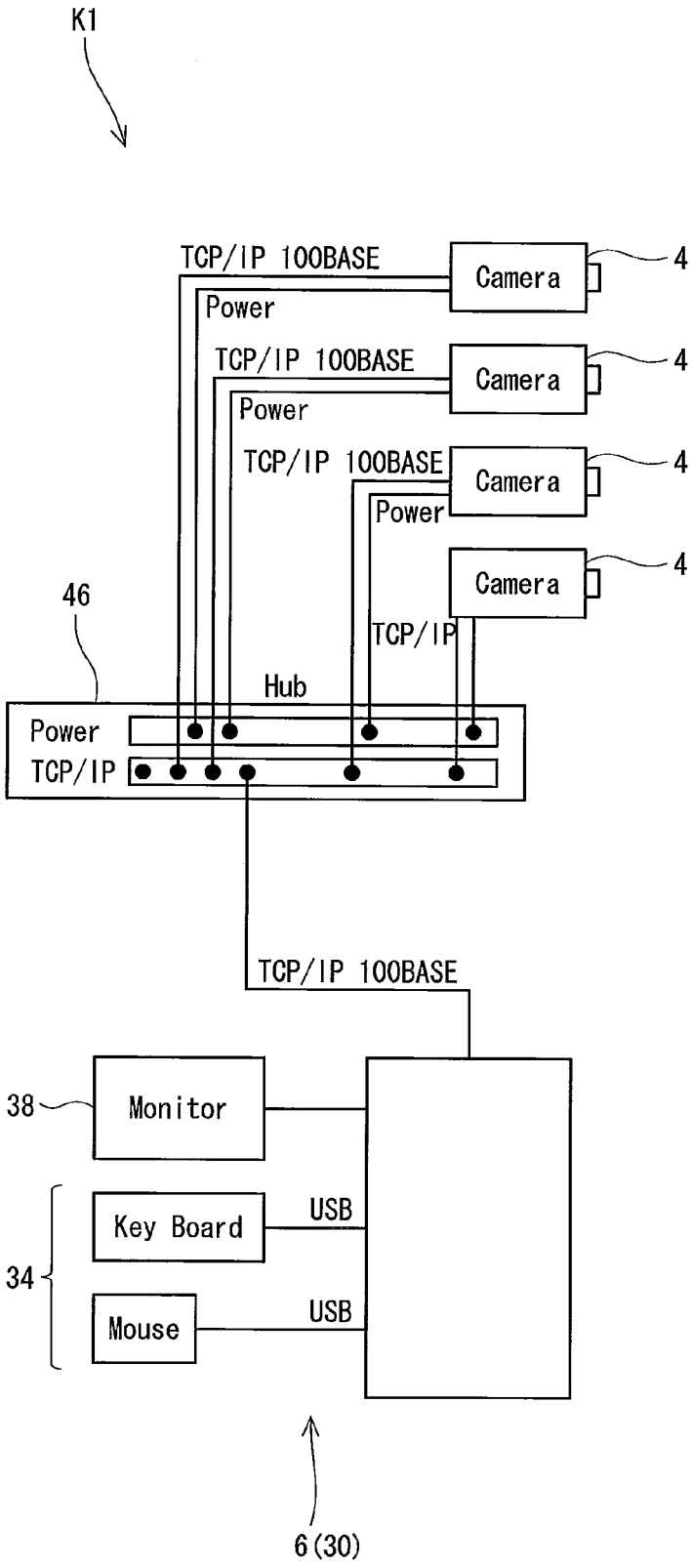
FIG. 4 is a view showing a schematic diagram of a system configuration of a swinging motion determination system which may be used according to the present invention.
Figure 5:
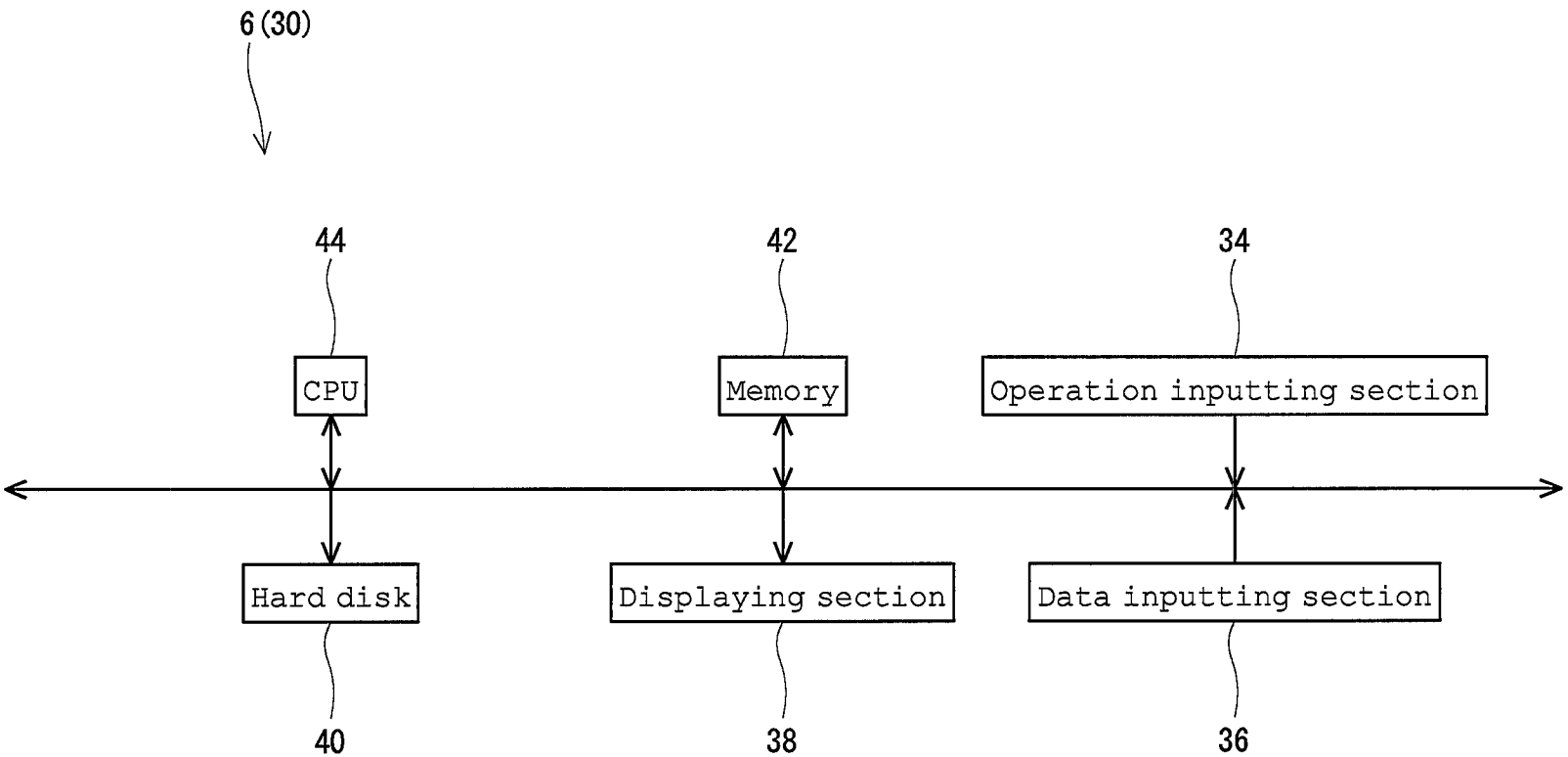
FIG. 5 is a view showing a hardware configuration of a data analyzing device which may be used according to the present invention.

FIG. 4 is a view showing an example of a schematic diagram of a system configuration of a swinging motion determination system (K1). FIG. 5 is a view showing an example of a hardware configuration of the data analyzing device 6 (a computer 30).

The data analyzing device 6 includes an operation inputting section 34, a data inputting section 36, a displaying section 38, a hard disk 40, a memory 42 and a CPU (Central Processing Unit) 44.

The operation inputting section 34 includes a keyboard and a mouse.

The data inputting section 36 includes an interface board (not shown), etc. for inputting the data outputted from the camera 4. The data inputted to the data inputting section 36 is outputted to the CPU 44.

The displaying section 38 is a display device, for example. The displaying section 38 is operable to display various kinds of data under the control by the CPU 44.

For example, the CPU 44 reads out programs stored in the hard disk 40 to develop the data in a working region of the memory 42 and performs various kinds of processes in accordance with the program.

For example, the memory 42 is a rewritable memory which provides a storage region of the programs and the inputted data which are read out from the hard disk 40, and a working region thereof.

The hard disk 40 stores the programs and the data or the like which are necessary to process the data and so on. These programs cause the CPU 44 to perform the necessary data processes.

For example, the programs which may be stored in the hard disk 40 are a three-dimensional coordinate calculating program and a three-dimensional center of gravity calculating program. The three-dimensional coordinate calculating program causes the CPU 44 to calculate the three-dimensional coordinate of the markers (mk). The three-dimensional coordinate is calculated based on the image information from the plurality of cameras 4. The three-dimensional coordinate is calculated regarding each of the times during the swinging operation. The three-dimensional coordinate data may be configured in the time series. The three-dimensional coordinate calculating program is used in a well known motion capturing system.

Examples of other programs may be a program for deciding the virtual swinging plane (PL1), a program for converting the three-dimensional coordinate into the two-dimensional coordinate by projecting the three-dimensional coordinate onto the virtual swinging plane (PL1), and so on. Such decision of the virtual swinging plane (PL1) and such projection of the three-dimensional coordinate onto the virtual swinging plane (PL1) will be described later.

Incidentally, the golf club (gc) is not limitative. The golf club (gc) may be for example a wood type golf club, a utility type golf club, a hybrid type golf club, an iron type golf club, a putter and so on. The wood type golf club is used in the embodiment as shown in FIG. 1.

With such a swinging motion determination system (K1), the three-dimensional coordinate of each of the markers (mk) is determined. It is preferred that the three-dimensional coordinate is a coordinate in a three-dimensional orthogonal coordinate system. For example, as that three-dimensional orthogonal coordinate system, an X-axis, a Y-axis and a Z-axis may be used as follow. The X-axis extends in a target direction of hitting the golf ball, i.e. a ball flying direction. The X-axis extends horizontally. The Y-axis extends in a fore/aft direction with respect to the testee (h1). The Y-axis extends perpendicularly to the X-axis. The Y-axis extends horizontally. The Z-axis extends perpendicularly to both the X-axis and the Y-axis. The Z-axis extends vertically. The X-axis and the Z-axis are shown in FIG. 1. The X-axis and the Y-axis are shown in FIG. 2. Other coordinate system may be employed than such a three-dimensional orthogonal coordinate system.

As shown in FIG. 4, the swinging motion determination system (K1) includes a hub 46. Through the hub 46, the swinging motion determination system (K1) forms a network. The motion capturing system forms a network, too. TCP/IP is used for a protocol of such a network.

Next, the determination of the swinging motion according to the present embodiment will be described in detail.

Figure 6:
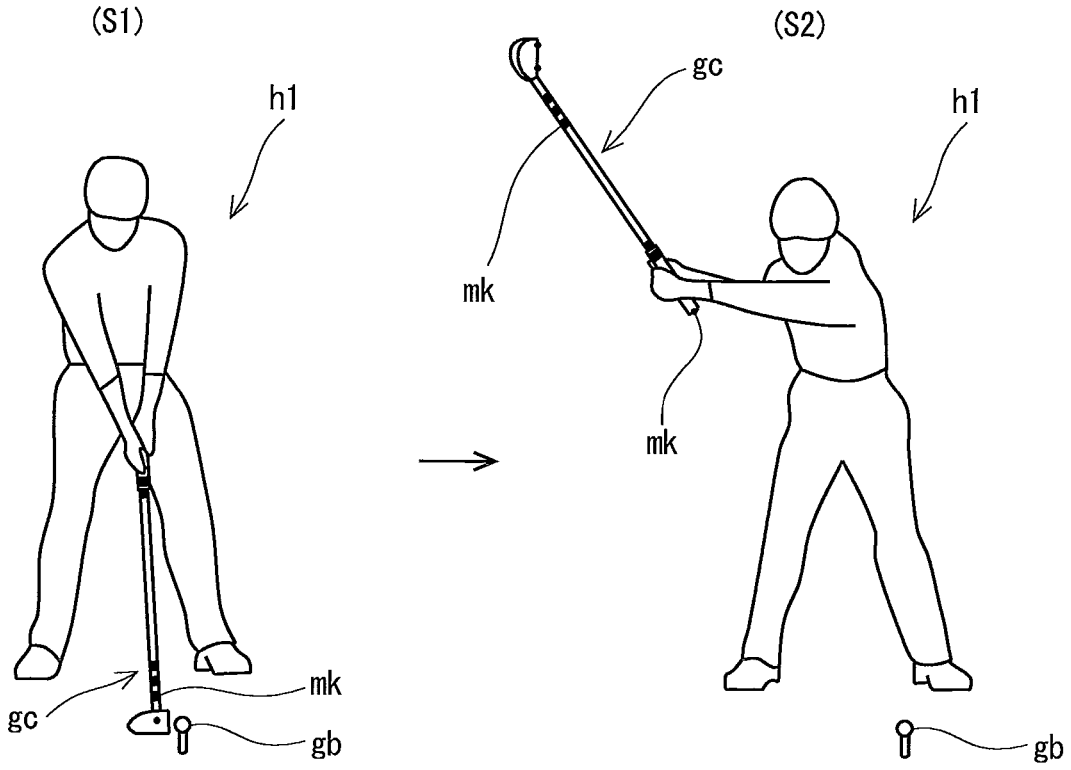
FIG. 6 is a view showing examples of a club swinging motion
Figure 7:
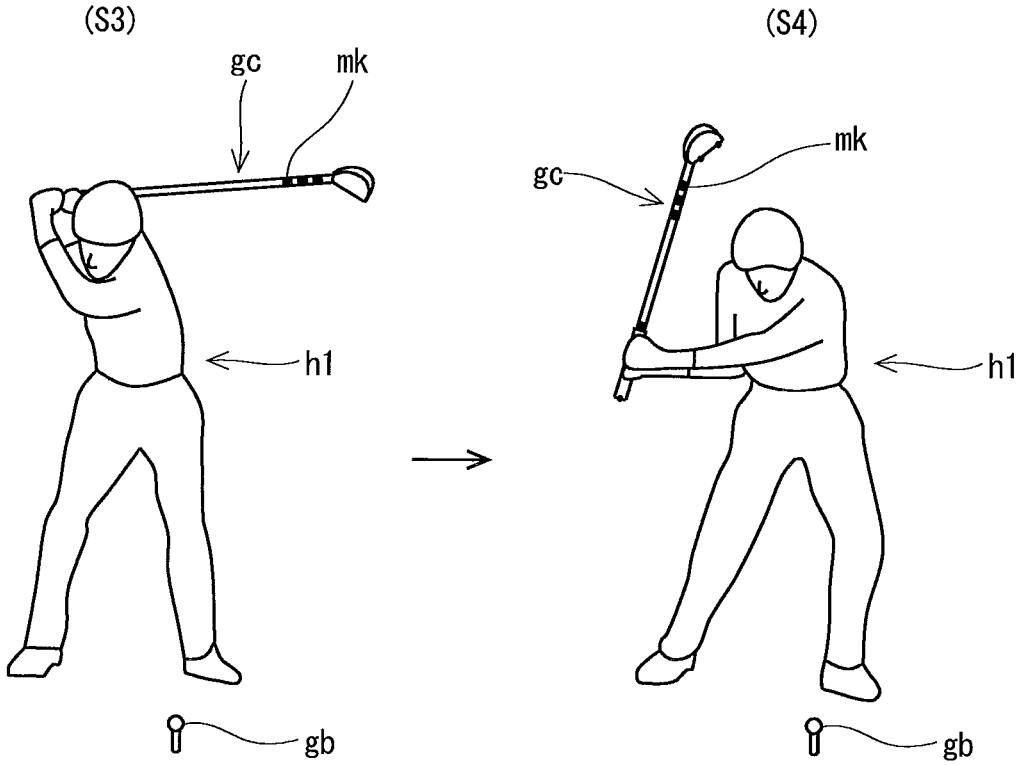
FIG. 7 is a view showing further examples of the club swinging motion
Figure 8:
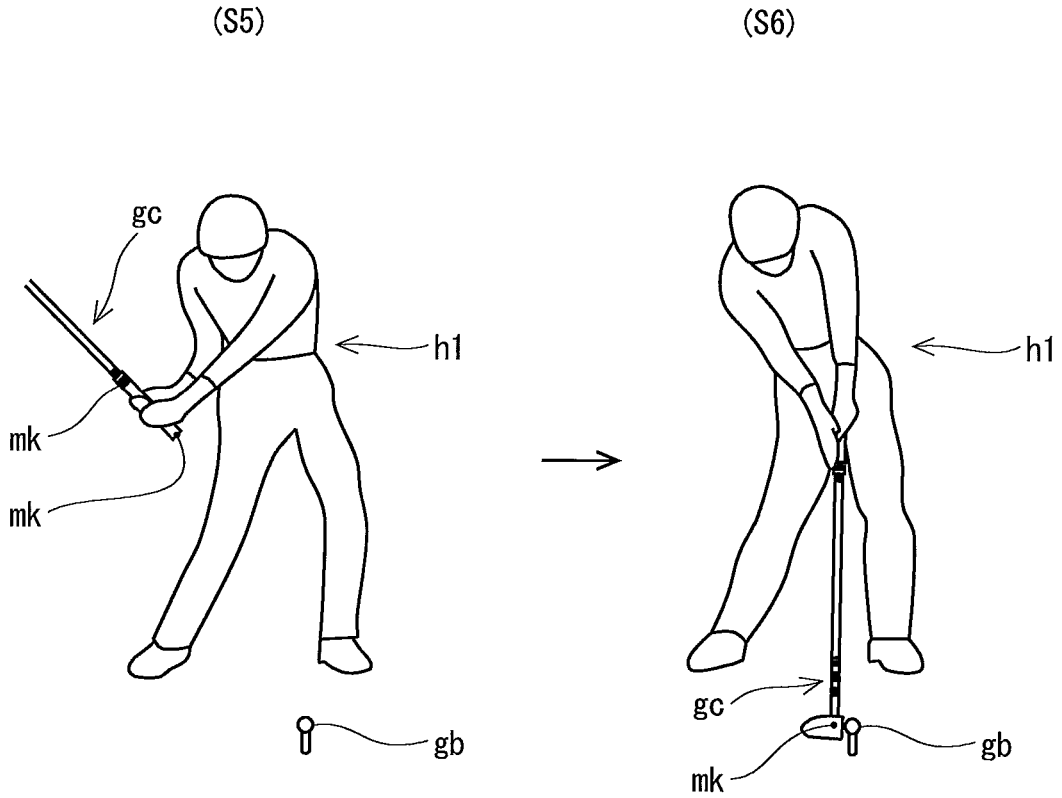
FIG. 8 is a view showing still further examples of the club swinging motion
Figure 9:
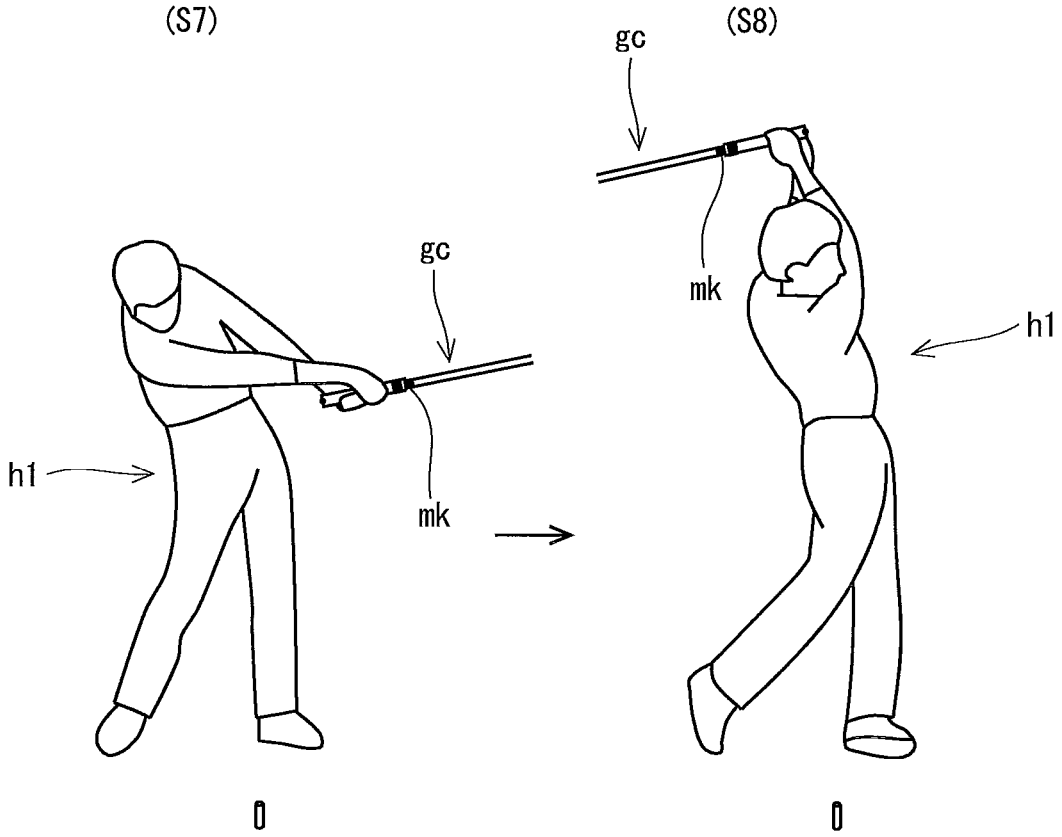
FIG. 9 is a view showing still yet further examples of the club swinging motion

FIG. 6 through FIG. 9 show typical swinging motions. The swinging motion starts with an address. The swinging motion ends by a so-called finish. The swinging motion proceeds in the order of motions: (S1), (S2), (S3), (S4), (S5), (S6), (S7) and (S8). FIG. 6 shows the motions (S1) and (S2). FIG. 7 shows the motions (S3) and (S4). FIG. 8 shows the motions (S5) and (S6). And, FIG. 9 shows the motions (S7) and (S8). The motion (S1) in FIG. 6 depicts an address. The motion (S2) in FIG. 6 depicts a taking-back motion. The motion (S3) in FIG. 7 depicts a top-of-the-swing (top motion). The top-of-the-swing may be defined by [Definition 1], [Definition 2] or [Definition 3] as below:

[Definition 1] The time when an angle between the grip axis direction, and the grip axis direction at the address, becomes a maximum value;

[Definition 2] The time when the head moving speed becomes minimum during the swinging motion;

[Definition 3] The time of a moment when the motion of a tip end of the grip is changed from a direction of a backswing to a direction of a downswing.

In the above [Definition 3], the tip end of the grip means by an end of the grip adjacent to the head.

The time adjacent to the top-of-the-swing may be a period ranging from the time 0.1 second prior to the time of the top-of-the-swing, to 0.1 second after the time of the top-of-the-swing.

The motion (S4) in FIG. 7 depicts a downswing. The motion (S5) in FIG. 8 depicts a downswing, too. The motion (S5) depicts a downswing advanced from the motion (S4). The motion (S6) in FIG. 8 depicts a impact (a impact). The impact means by the moment of collision of the head of the golf club (gc) against the golf ball (gb). The motion (S7) in FIG. 9 depicts a following-through motion. The motion (S8) in FIG. 9 depicts a finish. The swinging motion is terminated by the finish. According to the present invention, the motion of the golf club at least at one time (Tt1) during the swinging motion is determined.

A first aspect of the evaluation method according to the present invention is as below:

A method of evaluating a golf club comprising the steps of:

a step (Stp1) of determining motions of the golf club during a swinging motion of a golf player at least one time (Tt1); a step (Stp2) of obtaining a power index value (Pw) at least at one time (Tt2) during the swinging motion, based on the result of the determination a step (Stp3) of calculating club energy (Eg) of the golf club at the time (Tt2); and a step (Stp4) of quantitatively evaluating club suitability based on the power index value (Pw) and the club energy (Eg), wherein the power index value (Pw) is a value which is correlated to power of a work provided from the golf player to the golf club.

The time (Tt1) and the time (Tt2) may be different from each other, or may be identical.

The power index value (Pw) at the time (Tt1) is correlated to power of a work provided from the golf player to the golf club at this time (Tt1). The power index value (Pw) at a certain time (Tt1) may have larger influence on the club energy (Eg), compared with those at the other times. For example, it is expected that the power index value (Pw) immediately before the impact have larger influence on the club energy (Eg) at positions adjacent to the impact. From this point of view, it is preferred that the time (Tt1) is ranging from 0.15 second prior to the impact to the moment of the impact, and more preferably the time (Tt1) is ranging from 0.10 second prior to the impact to the moment of the impact. In furtherance thereto, it is expected that the power index values (Pw) at the impact largely influence on the club energy (Eg) adjacent to the impact (especially, on the club energy (Eg) at the moment of the impact). From this point of view, the time (Tt1) may be at the moment of the impact. Instead, the time (Tt1) may be the time adjacent to the moment of the top-of-the-swing, for example. Incidentally, the impact means by the moment when the golf ball starts to come into contact with the head of the golf club. When the golf player is swinging without using the golf ball, the impact means by the moment when a face surface of the head of the golf club reaches a position where the face surface would have come into contact with the golf ball.

The club energy (Eg) having the largest influence on the result of the golf ball having hit by the golf player is the club energy (Eg) at the moment of the impact. It is possible that the result of the hit golf ball is correlated to the club suitability. From the point of view of such, it is preferred that the time (Tt2) is ranging from 0.15 second prior to the impact, to the moment of the impact, and more preferably the time (Tt2) is ranging from 0.10 second prior to the impact, to the moment of the impact. Still more preferably, the time (Tt2) is ranging from 0.05 second prior to the impact to the moment of the impact. And, it is especially preferred that the time (Tt2) is the impact per se.

In furtherance thereto, it is expected that the club energy (Eg) immediately after the impact is highly correlated to the result of the golf ball having hit by the golf player. From this point of view, it is preferred that the time (Tt2) is ranging from the moment of the impact to 0.15 second after the impact; and more preferably the time (Tt2) is ranging from the moment of the impact to 0.10 second after the impact. Still more preferably, the time (Tt2) is ranging from the moment of the impact to 0.05 second after the impact.

In the present embodiment, the quantitative evaluation is done for the club suitability. The step of the evaluation as such is an example of the step (Stp4). For the purpose of the evaluation, a ratio (Pw1/Eg1) can be used. The value (Pw1) means by the power index value (Pw) at the time (Tt1). The value (Eg1) means by the club energy (Eg) at the time (Tt2). By using the ratio (Pw1/Eg1), for example, it is possible to effect the quantitative evaluation.

It is preferred that the time (Tt1) as described above is selected so that the ratio (A) (described later) is highly correlated to the club suitability (e.g. ease of the swinging).

The ratio (Pw1/Eg1) represents a proportion of the energy (Eg1) of the golf club that the power index value contributes to (This proportion will be referred to as the proportion (A) also). The higher the proportion (A) is, it is possible that the higher the club suitability is.

The term "club suitability" means by the suitability of the golf club to the golf player. The term "club suitability" is a concept including the "ease of swinging", "ease of hitting", "comfort of feeling the club" and so on. That is, the term "club suitability" is a concept related to how much the golf player goes well with the golf club. Typically, the term "club suitability" is the "ease of swinging".

The method of determination performed during the step (Stp1) is similar to the method of determination performed during a step (St1) which will be described later.

The method of calculating the power index value (Pw) performed during the step (Stp2) is similar to the method of the calculation performed during a step (St2) which will be described later.

Next, a second aspect of the method of evaluation will be described in detail.

A second aspect of the evaluation method according to the present invention is as below:

A method of evaluating a golf club comprising the steps of:

a step (St1) of determining motions of the golf club during a swinging motion of a golf player including a period ranging from a time (Ts) to a time (Tf);

a step (St2) of obtaining index values (Pw) in a time series power during the period ranging from the time (Ts) to the time (Tf), based on the result of the determination;

a step (St3) of obtaining a power integration value (Sp) by integrating the power index values (Pw) during the period ranging from the time (Ts) to the time (Tf);

a step (St4) of calculating club energy (Eg) of the golf club at the time (Tf); and a step (St5) of quantitatively evaluating club suitability based on the power integration value (Sp) and the club energy (Eg).

In the present invention, a predefined time during the swinging motion will be referred also as a "period". Thus, the time when the determination is done will be referred also as a determination period. According to the second aspect of the evaluation method, the motions of the golf club during the predefined determination period are determined. The result of the determination is the time series determination. The determination period may be an entire swinging motion or may be a part of the swinging motion. The time (Ts) is not limitative. The time (Tf) is not limitative, either, so long as the time (Tf) comes after the time (Ts).

The second aspect of the evaluation method includes a step (St1), a step (St2), a step (St3), a step (St4) and a step (St5) as below:

(1) a step (St1) of determining motions of the golf club during a swinging motion of a golf player including a period ranging from a time (Ts) to a time (Tf);

(2) a step (St2) of obtaining power index values (Pw) in a time series during the period ranging from the time (Ts) to the time (Tf), based on the result of the determination;

(3) a step (St3) of obtaining a power integration value (Sp) by integrating the power index values (Pw) during the period ranging from the time (Ts) to the time (Tf);

(4) a step (St4) of calculating club energy (Eg) of the golf club at the time (Tf); and (5) a step (St5) of quantitatively evaluating club suitability based on the power integration value (Sp) and the club energy (Eg).

One example of means for the determination during the step (St1) is the motion capturing system as described above. Other means for the determination will be described later.

The time (Ts) is not limitative. The time (Tf) is not limitative, either, so long as the time (Tf) comes after the time (Ts). The evaluation is effected during the period from the time (Ts) to the time (Tf).

During the step (St2), the power index value (Pw) is obtained in the time series. The time series data are a collection of a plurality of data during the period from the time (Ts) to the time (Tf). The number of the data is not limitative, but from the point of view of the determination precision, it is preferred that the number of the data is large. From this point of view, it is preferred that the number of the data during 1 second is no less than 100, more preferably no less than 200, and still more preferably no less than 250. From the point of view of the convenience of the data processing, on the other hand, the number of the data during 1 second may be small, e.g. no more than 1000. The number of the data during 1 second may be dependent on the sampling frequency of the swinging motion determination system (K1), for example.

During the step (St2), the three-dimensional data may be used as they are. Alternatively, the three-dimensional data may be used after converting them into the two-dimensional data. By projecting the three-dimensional coordinate onto a specific plane, the three-dimensional coordinate can be converted into the two-dimensional data. Conversion into the two-dimensional data simplifies the calculation.

From the point of view of simplified calculation, it is preferred that the step (St2) includes a step (St21) of projecting the three-dimensional coordinate of the markers (mk)

obtained by the motion capturing system onto a two-dimensional plane. The projected three-dimensional coordinate can be processed as the two-dimensional coordinate. Preferably, the two dimensional plane is the virtual swinging plane (PL1). Such projection will be described later in more detail.

It is preferred that the step (St2) includes a step (St22) in which a posture of a shaft of the golf club is calculated at each of the times, based on the three-dimensional coordinate of the markers (mk) obtained by the three-dimensional determination system (e.g. the motion capturing system). Preferably, the step (St22) further includes a step (St221) in which the posture of the shaft is calculated based on the two-dimensional coordinate obtained during the step (St21). It is preferred also that the step (St22) further includes a step (St222) in which an angular velocity (ω) of the grip and an angular acceleration value (ωcapped with one dot to be described later) of the grip are calculated based on the result of the calculation during the step (St221). During the step (St222), the angular velocity (ω) of the grip is preferably an angular velocity (ω) around an axis extending perpendicularly to the two-dimensional plane as described above. The calculation step of the angular velocity (ω) and so on will be described later in more detail.

It is preferred that the step (St2) includes a step (St23) in which an acceleration value at a center of gravity of the golf club is calculated at each of the times, based on the three-dimensional coordinate of the markers (mk) obtained by the three-dimensional determination system (e.g. the motion capturing system). It is preferred that during the step (St23), the acceleration value at the center of gravity is calculated based on the three-dimensional coordinate of the grip. That is, it is preferred that during the step (St23), the acceleration value at the center of gravity is calculated based on the markers (mk) provided on the grip. By using the three-dimensional coordinate of the grip, the influence resulting from flexing of the shaft can be excluded. From the point of view of simplified calculation, it is preferred that during the step (St23), the acceleration value at the center of gravity of the club is calculated based on the two-dimensional coordinate obtained by projecting the three-dimensional coordinate of the markers (mk) onto the two-dimensional plane. Preferably, the two-dimensional plane is the virtual swinging plane (PL1). From the point of view of simplified calculation, it is preferred that the acceleration value of the center of gravity of the club is calculated based on the result of the calculation performed during the step (St221). Preferably, based on the angular velocity (ω) and the angular acceleration value (ω capped with one dot to be described later), the velocity at the center of gravity and the acceleration value at the center of gravity are calculated. From the point of view of simplified calculation, it is preferred that the club is assumed as being a rigid body during the calculation of the velocity and the acceleration value at the center of gravity. That is, it is preferred that the club is assumed as being a rigid body during the step (St2). In this case, it is regarded that the shaft does not flex during the step (St2).

Of course, it is possible to directly calculate the acceleration value at the center of gravity of the club based on the determination result of the three-dimensional coordinate performed at the center of gravity or at a position adjacent thereto. In this case, preferably, it is assumed that the rigid body (Rb) extends between a rear end of the grip (the grip end) and the center of gravity of the club, and under that assumption, the calculation of the angular velocity (ω) is effected. Preferably, a connecting line between the rear end of the grip and the center-of-gravity point is the rigid body (Rb).

It is preferred that the step (St2) includes a step (St24) in which a torque (Tg) acting at the grip is calculated based on the calculated acceleration value at center of gravity of the club. It is preferred that during the step (St24), the Newton equation and the Euler equation are used. These equations are represented at the equation (2) described later. The calculation thereof will be described later in more detail.

It is preferred that the step (St2) includes a step (St25) in which the power index values (Pw) are calculated based on the torque (Tg), the angular velocity (ω), the velocity at the center of gravity and the acceleration value at the center of gravity which are calculated above. It is preferred that during the step (St25), the Newton equation and the Euler equation are used. These equations are represented at the equation (1) described later. The calculation thereof will be described later in more detail.

As described above, the power index values (Pw) are the value which is correlated to power of the work provided from the golf player to the golf club. The power index value (Pw) will be described later in more detail.

During the step (St3), the power integration value (Sp) is calculated. The power integration value (Sp) is a value which may be correlated to the work of the golf player provided to the golf club, during the period between the time (Ts) and the time (Tf).

During the step (St4), the club energy (Eg) at the time (Tf) is calculated. The calculation method thereof will be described later. The club energy (Eg) is a value which may be correlated to the energy applied to the golf club as the result of the swinging motion.

During the step (St5), based on the power integration value (Sp) and the club energy (Eg) as above, the club suitability is evaluated quantitatively. Each of the power integration value (Sp) is obtained as a numeric value, and the club energy (Eg) is obtained as a numeric value, too. The evaluation based on the power integration value (Sp) and the club energy (Eg) is done quantitatively.

It is preferred that the club suitability is evaluated based on the ratio (Sp/Eg), i.e. the ratio of the above power integration value (Sp) relative to the club energy (Eg).

The ratio (Sp/Eg) represents a contribution proportion of the power integration value to the club energy (Eg). This proportion, i.e. [(Sp/Eg)×100] (%) will be referred to as the contribution ratio also in the present invention. It is found that the higher the contribution ratio is, the higher the club suitability (e.g. the the ease of swinging) tends to become.

It is preferred that the club energy (Eg) can be represented by the equation (fm 1) as below:

$$Eg=(1/2)MV^2+(1/2)I\omega^2 \quad \text{(fm 1)}$$

In the equation (fm 1), "M" represents a mass of the golf club as a whole, "V" represents a translational velocity of the center of gravity of the club, "I" represents the moment of the inertia of the golf club, and "ω" represents the angular velocity of the center of gravity of the club.

Preferably, "I" represents the moment of inertia acting around an axis which extends through the center of gravity of the club and perpendicularly to the axis of the golf shaft. Alternatively, "I" may represent the moment of inertia acting around an axis which extends through any portion of the golf grip and perpendicularly to the axis of the golf shaft.

As above, "ω" represents the angular velocity of the center of gravity of the club. Preferably, the angular velocity "ω" is an angular velocity of the center of gravity of the club acting around an axis which extends through the grip end and perpendicularly to the axis of the golf shaft. Alternatively, the angular velocity "ω" may be an angular velocity acting around an axis which extends through another portion of the grip and perpendicularly to the axis of the golf shaft.

Assuming that the golf club as a whole is a rigid body, the angular velocity "ω" becomes equal to the angular velocity of the entire golf club. From the point of view of the calculation facility, it is preferred to assume that the golf club as a whole is a rigid body when the angular velocity "ω" is to be calculated.

When taking account of the fact that the swinging motion is complicated, "(½) $MV^2$" can be regarded as the approximate value of the kinetic energy of the golf club. Similarly, "(½) $I\omega^2$" can be regarded as the approximate value of the rotation energy of the golf club. The club energy (Eg) represent by the equation (fm1) is a sum of the approximate value of the kinetic energy of the golf club, and the approximate value of the rotation energy of the golf club.

In furtherance to the kinetic energy and the rotation energy, the energy of the golf club includes the transforming energy of the shaft, the positional energy of the golf club and so on. This means that the equation (fm 1) does not take account of all of the energies of the golf club. However, the kinetic energy and the rotation energy are larger than the other energies. It is assumed that the kinetic energy and the rotation energy occupy major parts of the energies of the golf club. The kinetic energy and the rotation energy can explain substantially all of the energies of the golf club. From the point of view of effecting the convenient and highly significant evaluation, it is preferred that the club energy (Eg) is the sum of the kinetic energy or an approximate value thereof, and the rotation energy and an approximate value thereof.

It should be noted that the motions of the golf club during its swinging motion are quite complicated. Therefore, it is sometimes difficult to obtain a precise calculation value of the kinetic energy of the golf club. Similarly, it is sometimes difficult to obtain a precise calculation value of the rotation energy of the golf club. However, even if the value of the kinetic energy and the rotation energy are approximated, it is possible to evaluate the club suitability.

It should be noted also that it is possible to calculate the club energy (Eg) by using the imaging system determination method like the motion capturing system as described above, the consecutive photographs of the golf club, etc. And, it is possible to use a sensor which determines the velocity, the acceleration value, etc. of each portions of the golf club, in order to calculate the club energy (Eg). For example, it is possible to calculate the club energy (Eg) based on the determined value of the gyroscope mounted on the golf club, or various sensors such as an acceleration value determination device.

Instead of these, it is possible to calculate the club energy (Eg) based on other equations than the equation (fm 1). For example, the club energy (Eg) may be the kinetic energy only (i.e. (½) $MV^2$ only). More conveniently, the club energy (Eg) may be the kinetic energy of the golf head. The proportion of these energies is regarded as being relatively large in the energies of the golf clubs a whole. Therefore, even if these energies are used as the club energy (Eg), it is assumed that the ratio (Sp/Eg) may exhibit the tendency of the club suitability. With taking account of the evaluation precision and the calculation convenience, various methods can be used to calculate the club energy (Eg).

It is preferred if the time (Tf) is a time of a impact. If the time (Tf) is the time the impact, the club energy (Eg) is the club energy at the time of the impact. The club energy at the time of the impact tends to be the most influencing factor on the result of the ball hit by the golf player. Similarly, the club energy at a time adjacent the impact tends to be the most influencing factor on the result of the ball hit by the golf player. It is assumed that the result of ball hit by the golf player and the club suitability are correlated. Therefore, the club energy (Eg) adjacent the impact is important when the club suitability is evaluated. From this point of view, it is preferred that the time (Tf) is one of the times between 0.05 second prior to the impact and 0.05 second after the impact, and more preferably at the time of the impact.

Incidentally, sometimes the evaluation of the club suitability (e.g. the ease of swinging) does not meet the result of the ball hit by the golf player. For example, the result of the ball hit by the golf player sometimes turns to be nice, even if the golf player feels that the golf club is difficult to swing. Thus, it is expected that the club energy (Eg) do not always have to be set to be the club energy adjacent the impact. For example, when the golf player takes the golf club as "easy to swing" if it is "easy to swing out", it is sometimes possible to regard it more suited to use the club energy (Eg) at the time after the impact than the club energy (Eg) at the time the impact when evaluation of the club suitability. In these manners, the time (Tf) can be set appropriately depending on the personal characteristics of the golf player, and the characteristics of the golf club.

The time (Ts) is not limitative, so long as it comes prior to the time (Tf). Preferably, the time (Ts) is a time adjacent a top-of-the-swing. If the time (Ts) is a time adjacent the top-of-the-swing and if the time (Tf) is a time adjacent the impact, the power integration value (Sp) is a value corresponding to the work provided by the golf player to the golf club during the downswing. The power for moving the golf club is provided to the golf club during the downswing. From this point of view, it is preferred that, the power integration value (Sp) is a value obtained by integrating the the power index value (Pw) during the downswing. Thus, it is preferred that the time (Ts) is a time adjacent the top-of-the-swing and the time (Tf) is a time adjacent the impact.

The time necessary to the downswing depends on the golf player, but a difference thereof is relatively small. Therefore, it is possible to set the time (Ts) by taking account of the period which an average golf player needs during the downswing. From this point of view, it is preferred if the time (Ts) can be set to one of times ranging from 0.25 second prior to the impact, to 0.35 second prior to the impact, for example.

Instead of above, it is also preferable if the time (Ts) is set to one of the times during the downswing. During the downswing, there may be a time or times especially influencing on the club suitability. In these manners, the time (Ts) can be set appropriately depending on the personal characteristics of the golf player, and the characteristics of the golf club.

Next, the method of calculating the power index value (Pw) will be described.

The power index value (Pw) is a concept which corresponds to a power provided by the golf player to the golf club. This power means by "power of work". The power of work is an amount of work performance per a unit of time. The power of work of the translational motion is calculated by multiplying the "force" and the "velocity". The power of work of the rotational motion is calculated by multiplying the "torque (moment of force)" and the "angular velocity".

It is preferred that the power index value (Pw) is a sum of values (a) and (b) as below:

(a): the power index value (Pw A) related to the translational motion of the golf club; and (b): the power index value (Pw B) related to the rotational motion of the golf club.

When taking account of the power index value (Pw A) related to the translational motion of the golf club and the power index value (Pw B) related to the rotational motion of the golf club, it is possible to obtain the value which corresponds to the power provided by the golf player to the golf club. By taking account of both the rotational motion and the translational motion, the evaluation precision may be improved.

It is possible to obtain the power integration value (Sp) by integrating the power index values (Pw) from the time (Ts) to the time (Tf). It is possible to regard the power integration value (Sp) as a value corresponding to the amount of work provided by the golf player to the golf club from the time (Ts) to the time (Tf).

It is preferred that during the step (St5), the power integration value (Sp) and the club energy (Eg) are used to effect the quantitative evaluation. More preferably, the evaluation is done based on the ratio (Sp/Eg).

The value [(Sp/Eg)×100] (%) represents a contribution ratio of the power integration value (Sp) to the club energy (Eg). It is found that the higher the contribution ratio is, the higher the club suitability (e.g. the ease of swinging) tends to become. This contribution ratio is a proportion of the power index value (Pw) among the club energy (Eg) obtained by the golf club. If the value for calculating the contribution ratio is an approximate value, then the contribution ratio is an approximate value, too. As will be described later, it is rational if the contribution ratio is the approximate value, taking account of the fact that the swinging motion is complicated. Even though the contribution ratio is the approximate value, this contribution ratio can be regarded as being precise, since the contribution ratio is obtained by taking account of values related to the rotational motion and the translational motion.

Hereinafter, one example of preferable calculating method of the power index value (Pw) will be described in more detail.

The power index value (Pw A) is expressed by the following equation (fm 2):

$$Pw\,A = F1 \times V1 \quad \text{(fm 2)}$$

where (F1) is a driving force of the translational motion and (V1) is a velocity of the center of gravity in the equation (fm 2). In the equation (1) which will be described later, the velocity (V1) is represent by a character "r" with one dot appended thereto. The driving force of the translational motion (F1) is obtained under the Newton equation. That is, the force (F1) is obtained by multiplying a mass of the golf club (M) by a value [(r-two-dot)−(weight acceleration value (g))]. The r-two-dot is the acceleration value of the center of gravity.

On the other hand, the power index value (Pw B) is expressed by the following equation (fm 3):

$$Pw\,B = Tg \times \omega \quad \text{(fm 3)}$$

Wherein (Tg) is a torque (moment of force provided to the golf club and (ω) is an angular velocity of the golf club.

It is preferred that the power index value (Pw) is a sum of the power index value (Pw A) and the power index value (Pw B). When the Newton's equation of motion is applied to the power index value (Pw A), while the Euler's equation of motion is applied to the power index value (Pw B), the power index value (Pw) can be expressed by the equation (1) as below:

$$Pw = M\cdot(\ddot{r} - g)\cdot\dot{r} + Tg\cdot\omega \quad (1)$$

where, in the equation (1), "M" is a weight of the golf club; "$\ddot{r}$" (with two dots appended thereto) is an acceleration of the center of gravity of the golf club; "g" is an acceleration of gravity; "$\dot{r}$" (with one dot appended thereto) is a velocity of the center of gravity of the golf club; "Tg" is a torque acting around a rotation axis (Z1) extending perpendicularly to a virtual swinging plane (PL1) and passing through the golf grip; and "ω" is an angular velocity of the golf grip.

In the present application, "$\dot{r}$" (with one dot appended thereto) is also referred as "r-one-dot"; and "$\ddot{r}$" (with two dots appended thereto) is also referred as "r-two-dot".

The swinging motion is quite complicated. The golf club is making a rotational motion around an axis extending adjacent to a part of the grip, but a rotation axis thereof is not a fixed axis. Precisely, the rotation axis is constantly moving during the swinging motion.

With taking account of such a complicated swinging motion, it is preferred that the approximate rotation axis is set when the power index value (Pw) is calculated. An example of such an approximate rotation axis will be a rotation axis (Z1) extending perpendicularly to the virtual swinging plane (PL1) and passing through the grip.

The virtual swinging plane (PL1) is a concept close to a so called "swinging plane". The swinging motion is complicated and the swinging plane is not a complete plane. With taking account of the complicated swinging motion, it is preferable to set the virtual swinging plane (PL1). The virtual swinging plane (PL1) is an approximate swinging plane. By setting the virtual swinging plane (PL1), the rotation axis (Z1) is set.

It is preferable that the virtual swinging plane (PL1) is obtained by approximating the determined data of the swinging motion. The virtual swinging plane (PL1) is selected by, for example, using the time series data of the coordinate of the markers (mk) which are determined by the motion capturing system. When selecting the virtual swinging plane (PL1), the data used may be for one and only markers (mk), or for two or more markers (mk).

The position(s) of the marker(s) (mk) used for deciding the virtual swinging plane (PL1) is/are not limitative. From the points of view excluding the influence resulting from the flexing of the golf shaft and approximating the virtual swinging plane (PL1) to the actual swinging plane as close as possible, the virtual swinging plane (PL1) is preferably selected based on the three-dimensional data of the grip 24. Preferably, for example, the virtual swinging plane (PL1) is selected based on the three-dimensional data of the markers (mk) provided on the grip 24.

Figure 10:
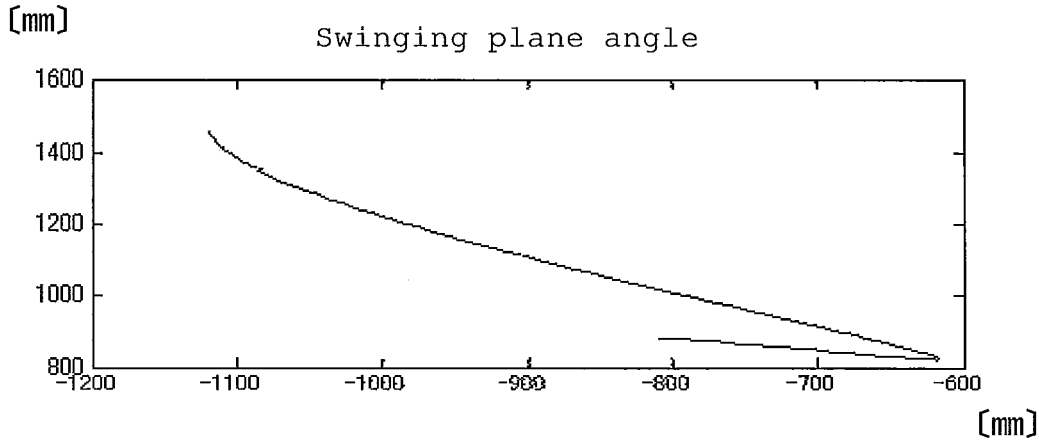
FIG. 10 is a graph for explaining an example of a method of determining a virtual swinging plane (PL1)

FIG. 10 is a graph showing an example of a locus during the downswing, of the markers (mk) which are provided on the grip end. FIG. 10 shows that locus from 0.3 second prior to the impact to the impact. The locus is obtained by projecting the three-dimensional coordinate onto the Y-Z plane. In the graph in FIG. 10, the horizontal axis corresponds to the Y-coordinate, and the vertical axis corresponds to the Z-coordinate. These coordinates are those in the three-dimensional orthogonal coordinate system as described above (see FIG. 1 and FIG. 2).

The shape of the graph in FIG. 10 is close to the swinging plane as seen from behind position of a ball flying direction (the position on a negative side of the X-axis). The virtual swinging plane (PL1) is obtained by, for example, by approximating the curve line of the graph in FIG. 10 to the straight line (Lyz). To effect such approximation, the least square method is employed, for example. When the straight line (Lyz) on the Y-Z plane obtained by such an approximation method is developed onto any positions on the X-coordinate, it is possible to obtain the virtual swinging plane (PL1) as a collection of the straight line (Lyz). When the approximation was done with using the least square method in the embodiment as shown FIG. 10, an angle of the virtual swinging plane (PL1) relative to the Y-axis was 51 degrees.

The virtual swinging plane (PL1) can be calculated by the method as described above, for example. Alternatively, the three-dimensional coordinate of the markers (mk) can be used as it stands for approximating the three-dimensional locus of the markers (mk) to decide the virtual swinging plane (PL1). Still alternatively, the virtual swinging plane (PL1) may be decided based on the swinging motion images in the consecutive photographs, movies or the like.

In the equation (1), the acceleration value (r with two dots appended) of the center of gravity of the club is used. The acceleration value of the center of gravity of the club can be calculated based on the time series data of the markers (mk) provided at the center of gravity of the club.

Instead of above, the acceleration value at the center of gravity may be calculated based on the coordinate data of the markers (mk) other than the markers (mk) provided at the center of gravity of the club. From the point of view of simplifying the calculation by neglecting the influence resulting from the flexing of the club shaft, the calculation can be done by assuming that the golf club as a whole is a rigid body. Since the position of the center of gravity of the club is already known, the acceleration value of the center of gravity of the club can be calculated based on the three-dimensional coordinate data other than the center of gravity of the club.

Instead of above, the acceleration value of the center of gravity of the club can be calculated based on the coordinate data of the markers (mk) provided at the center of gravity of the club and the coordinate data of the markers (mk) provided at other positions than the center of gravity of the club.

From the point of view of excluding the influence resulting from the flexing of the club shaft, the acceleration value of the center of gravity of the club can be calculated based on the coordinate data of the grip.

As described above, the acceleration value of the center of gravity of the club can be calculated with using the three-dimensional coordinate data of the markers (mk). Other than this calculating method, the three-dimensional data may be projected on the virtual swinging plane (PL1), and based on the resulting two-dimensional data, the acceleration value of the center of gravity of the club may be calculated. By projecting the three-dimensional data on the plane, the three-dimensional coordinate of the markers (mk) can be converted into the two-dimensional coordinate. Such a conversion simplifies the calculation. Besides, as described above, the virtual swinging plane (PL1) is close to the actual swinging plane. Therefore, the acceleration value of the projected image onto the virtual swinging plane (PL1) is close to the actual acceleration value. From these points of view, it is preferable to use the projected image onto the virtual swinging plane (PL1) in order to calculate the acceleration value of the center of gravity of the club. From the point of view of simplifying the calculation, it is preferable to make that projection in a direction vertical relative to the virtual swinging plane (PL1).

Figure 11:
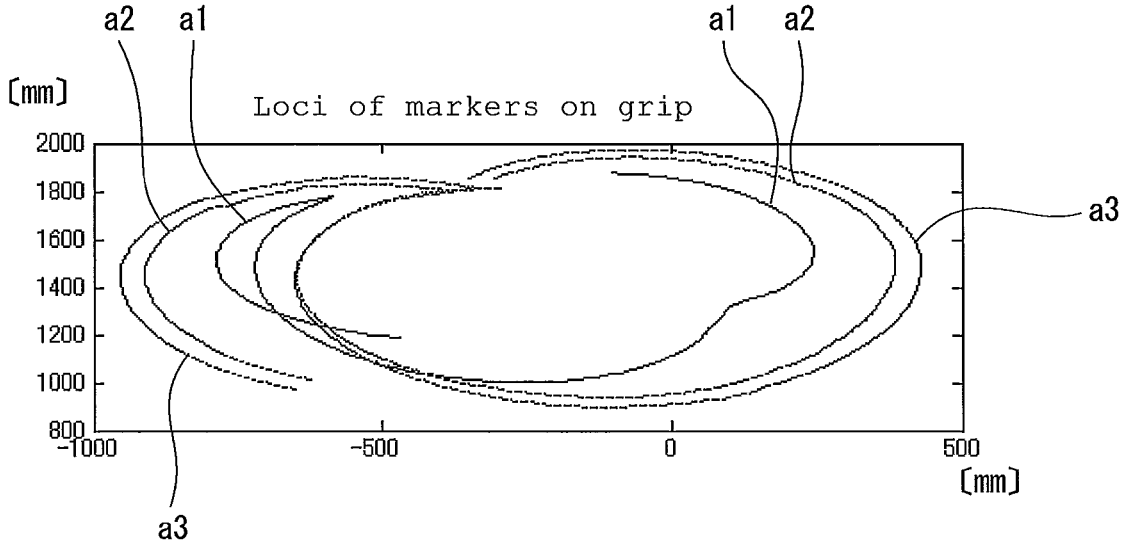
FIG. 11 is a graph showing loci of markers (mk) projected on the virtual swinging plane (PL1)

FIG. 11 shows curves each obtained by projecting, on the virtual swinging plane (PL1), the loci of the markers (mk) provided on the grip. A curve (a1), a curve (a2) and a curve (a3) are all obtained simultaneously during one swinging motion. The curve (a1), the curve (a2) and the curve (a3) are different loci of different markers (mk). In more specific, the curve (a1) is a locus of the marker (mk) provided on the grip end. The curve (a2) is a locus of the marker (mk) provided on an end of the grip closer to the club head. And, the curve (a3) is a locus of the marker (mk) provided on the shaft at a position adjacent to an end of the grip closer to the club head.

Figure 12:
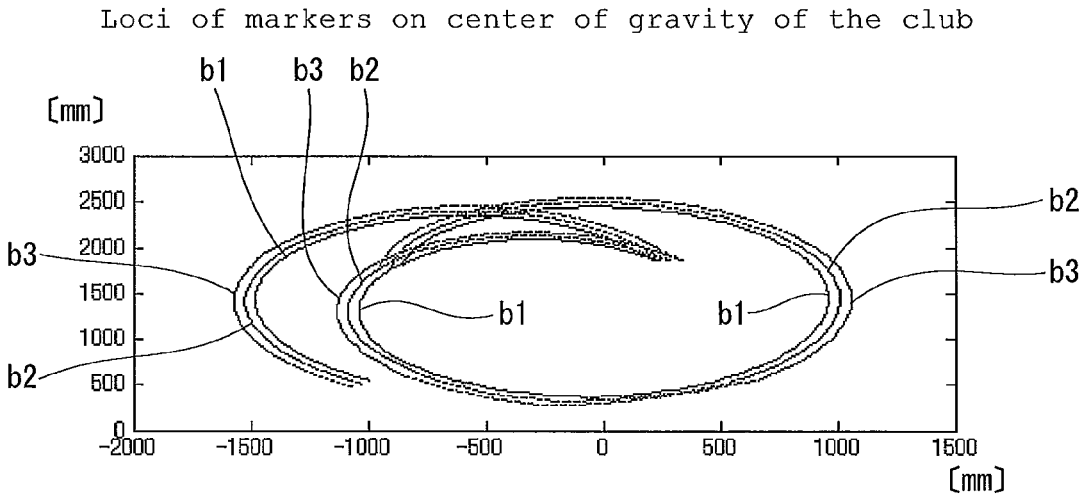
FIG. 12 is a graph showing loci of another markers (mk) projected on the virtual swinging plane (PL1)

FIG. 12 shows curves each obtained by projecting, on the virtual swinging plane (PL1), the loci of the markers (mk) provided at the center of gravity of the club. A curve (b1), a curve (b2) and a curve (b3) are all obtained simultaneously during one swinging motion. The curve (b1), the curve (b2) and the curve (b3) are different loci of different markers (mk). In more specific, the curve (b1) is a locus of the marker (mk) provided at a grip side position adjacent to the center of gravity of the club. The curve (b2) is a locus of the marker (mk) provided at the center of gravity of the club. And, the curve (b3) is a locus of the marker (mk) provided at a head side position adjacent to the center of gravity of the club and closer to the head.

As shown in FIG. 11 and FIG. 12, motions of the markers (mk) can be captured in a two-dimensional manner by projecting the markers (mk) on a plane. This allows for easy calculation of the velocity of the center of gravity of the club, as well as the acceleration value of the same.

It is to be noted that strictly, the center of gravity of the club is not located on the shaft or within the shaft, but in a space close to the shaft. The acceleration value of the center of gravity of the club may be the acceleration value of the "strictly meaning of the center of gravity of the club" located in that space. On the other hand, among the markers (mk) as described above, the marker (mkg) provided at the center of gravity of the club is shown in FIG. 3. The location of the marker (mkg) is different from the "strictly meaning of the center of gravity of the club", but quite close thereto. Thus, in the present application, the acceleration value of the markers (mkg) too will be regarded as the acceleration value at the center of gravity of the club. The position of that marker (mkg) is a position where balancing can be done when the golf club (gc) is supported at one and only point.

In the equation (1), a torque (Tg) is used. The torque (Tg) is obtained by the Euler equations. In more particular, the torque (Tg) is obtained by the equation (2) as below:

$$Tg=I\dot{\omega}+r\times F1 \tag{2}$$

where, in the equation (2), "I" is a moment of inertia of the golf club; "$\dot{\omega}$" (ω-one-dot) is an angular velocity of the golf grip; "r" is a distance to the center of gravity of the golf club; and "F1" is a translational motion driving force.

The moment of inertia (I) is the moment of inertia of the entire golf club. For example, the moment of inertia (I) is set to the moment of inertia (Ia) acting around an axis (a1) which extends through the center of gravity of the club and perpendicularly to the axis of the shaft. During the actual swinging motion, the golf club does not rotate about a rear end of its grip. The actual swinging motion is more complicated. During the actual swinging motion, it is assumed that the golf club has its rotation axis being moved. Hence, the moment of inertia (I) has no choice but be an approximate value.

The mark "ω-one-dot" is an angular acceleration value of the grip. This value is obtained by differentiating the angular velocity value (ω) of the grip. The angular velocity value (ω) will be described in more detail later.

In the equation (2), the force (F1) is the translational motion driving force as described above. As described above, the force (F1) is calculated by the Newton equation.

In the equation (2), the mark (r) is a distance to the center of gravity of the golf club. For example, the distance (r) is a length from the rear end of the grip to the center of gravity of the golf club. Instead, the distance (r) may be a distance from any point of the grip to the center of gravity of the golf club.

In the equation (1), the angular velocity (ω) of the grip is used. If the flexing of the shaft is neglected, the angular velocity (ω) is equal to the angular velocity of the golf club, and is equal to the angular velocity of the shaft. In the equation (1), from the point of view of excluding the influence resulting from the shaft flexing, the angular velocity (ω) of the grip is used. However, since the amount of the flexing is quite limited, the angular velocity of the golf club is close to the angular velocity (ω) of the grip, and the angular velocity of the shaft is close to the angular velocity (ω) of the grip, too. From this point of view, instead of the angular velocity (ω) of the grip, the angular velocity of the golf club or the shaft may be used.

The angular velocity (ω) of the grip can be calculated based on the three-dimensional coordinate data of two markers (mk) provided on the grip. From the point of view of simplifying the calculation, instead of this three-dimensional data, the angular velocity (ω) can be calculated based on the two-dimensional data obtained by projecting, on a plane, the three-dimensional coordinate of the marks (mk). As described above, the virtual swinging plane (PL1) as described above is preferable as such a projected plane. When the data is used after projecting them onto the virtual swinging plane (PL1) and thus converting them into the two-dimensional data, it is possible to obtain a value close to the actual angular velocity (ω). It is to be noted that due to deformation each of the grip and the shaft, it is possible to cause a slight difference between the angular velocity (ω) calculated in this way and the actual angular velocity. From the point of view of suppressing such a difference, it is preferable to assume that a connecting line between the grip end and the center of gravity of the golf club is a rigid body, when the angular velocity (ω) is calculated.

In the above manners, based on the equation (1) and the equation (2), the power index value (Pw) can be calculated. And, it is possible to obtain the power integration value (Sp) by processing the time series data of the power index value (Pw) into a graph, and by integrating this graph of the power index value (Pw).

Figure 13:
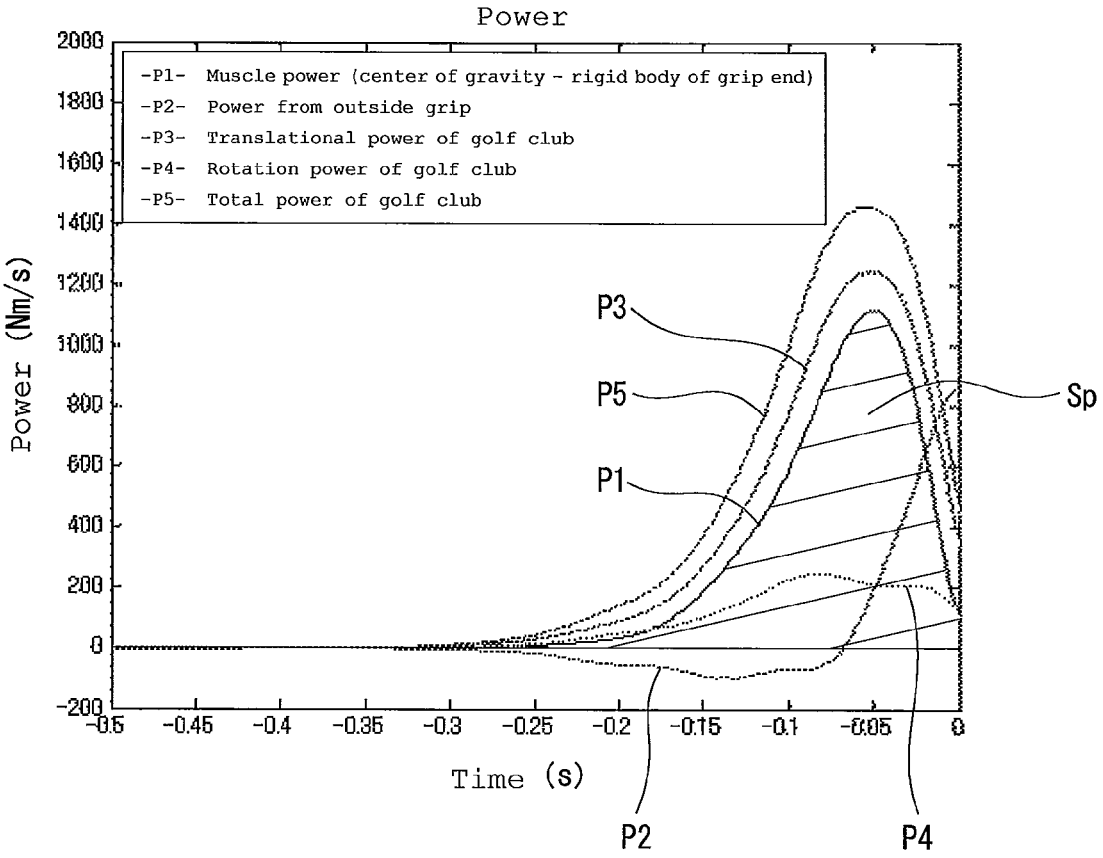
FIG. 13 shows graphs each showing an example of time series data of power index value (Pw)—an area in hatching in FIG. 13 shows an example of a power integration value (Sp)

FIG. 13 is an example of the graphs showing the time series data of the power index value (Pw). In the graphs in FIG. 13, the vertical axis represents the power (Nm/s) and the horizontal axis represents a period of time. In this horizontal axis, the time of the impact is located at 0.0 second. This graph covers from a time adjacent to the top-of-the-swing to a time of the impact. In the graph in FIG. 13, the curve (P1) represents the power index value (Pw). A shadow area shows the power integration value (Sp). The shadow area is the power integration value (Sp), when it is assumed that the time (Ts) is a time adjacent a top-of-the-swing and the time (Tf) is a time of impact.

The curve (P2), the curve (P3), the curve (P4) and the curve (P5) are reference data. The curve (P5) represents the "total power of the golf club" which is a sum of the "rotation power of the golf club" (curve (P4)) and the "translational power of the golf club" (curve (P3)). The "rotation power of the golf club" (curve (P4)) means a value obtained by multiplying the moment of inertia (I) by the angular velocity (ω), that is, angular momentum. The "translational power of the golf club" (curve (P3)) means a value obtained by multiplying the mass of the golf club (M) by the velocity of the center of gravity of the club (V1), that is, kinetic momentum.

The ratio (Sp/Eg) is calculated based on the data in FIG. 13. The club energy (Eg) in this case is the club energy (Eg) at the impact. Further, in the data in FIG. 13, the power integration value (Sp) is correlated to the work provided to the golf club during the substantially entire downswing motion. It is assumed that the golf club having a high degree of the contribution ratio has a high degree of the club suitability. This is demonstrated in the embodiment described later.

In these manners, taking account of the power index value (Pw) and the club energy (Eg), the quantitative evaluation of the club suitability can be effected.

It is assumed that the torque applied by the golf player to the golf club is mainly resulting from a turning action of the wrists of the golf player. Of course, there should be the torque resulting from actions other than the turning action of the wrists. It is assumed that the torque (Tg) as described above approximately represents the torque provided by the golf player to the golf club.

The translational motion driving force, provided by the golf player to the golf club, can be mainly regarded as the "power which is applied in a direction of the swinging motion and provided by the golf player to the golf club by his/her body twist and arm motion". That power applied in the direction of the swinging motion can be rephrased into a power applied in a direction of movement of the center of gravity of the golf club. The force (F1) is regarded as representing the translational motion driving force approximately, which power is provided by the golf player to the golf club.

Incidentally, the golf player comes into contact with the golf club at the grip only. Hence, all of the power and the torque that is transmitted from the golf player to the golf club goes through the grip before reaching the golf club. Taking account of this, the torque (Tg) can be regarded as a torque approximate to what is actually provided from the golf player to the grip.

With respect to the translational motion driving force, the golf player does not press "the center of gravity of the club", since the golf player is gripping the grip. Therefore, the golf player does not provide the center of gravity of the club with the translational motion driving force. However, in order to understand a total amount of the work that the golf player provided to the golf club, it is possible to divide the work into the "work resulting from the translational motion" and the "work resulting from the rotational motion". Thus, the power which the golf player provided to the golf club (the power) can be expressed, as an approximate value, by the equation (1) as described above. In other words, among the power provided from the golf player to the golf club, the power related to the "translational motion" may be regarded as being approximated to the "translational motion driving force (F1) applied to the center of gravity of the club".

EXAMPLE(S)

Hereinafter, the effects of the present invention will be apparent by the example. However, the scope of the present invention should not be construed as being limitative based on the description of the example.

The effects of the present invention were confirmed by comparing the contribution ratio with the sensuous evaluation. Three golf players: Testee (A), Testee (B) and Testee (C) conducted the test. Five golf clubs having different specifications (W #1: driver) were used during the test. Each of the three golf players evaluated the five golf clubs if they are easy to swing. Such an evaluation is the sensuous evaluation.

Each of the five golf clubs has a real loft angle thereof 10.5 degrees, a lie angle thereof 56 degrees and a length thereof 45 inches. The specification each of the five golf clubs is as below:

Golf Club (gc1): Total weight: 295 g, Head weight: 190 g, Forward Flex: 130 mm;

Golf Club (gc2): Total weight: 320 g, Head weight: 200 g, Forward Flex: 80 mm;

Golf Club (gc3): Total weight: 320 g, Head weight: 200 g, Forward Flex: 200 mm;

Golf Club (gc4): Total weight: 290 g, Head weight: 190 g, Forward Flex: 120 mm; and Golf Club (gc5): Total weight: 310 g, Head weight: 200 g, Forward Flex: 130 mm.

The "Forward Flex" means by an amount of flexing of the golf club, which amount is determined with its one end closer to the grip being fixed and the other end closer to the head pending the weight. The larger is the value thereof, the larger is the amount of flexing of the golf club.

The result of the sensuous evaluation was as follows: Testee (A) evaluated Golf Club (gc1) as the easiest to swing; and Golf Club (gc2) as the most difficult to swing. Testee (B) too evaluated Golf Club (gc1) as the easiest to swing; and Golf Club (gc2) as the most difficult to swing. Also, Testee (C) evaluated Golf Club (gc1) as the easiest to swing; and Golf Club (gc2) as the most difficult to swing.

The swinging motion of the golf clubs was determined as for one evaluated as the easiest to swing; and another one evaluated as the most difficult to swing. For that determination, the motion capturing system as described above was used. As that motion capturing system, one manufactured by Motion Analysis Corporation and traded as "MAC 3D SysTem" was used. This is an optical motion capturing system. As the camera, one manufactured by Motion Analysis Corporation and traded as "Eagle Digital Camera" was used. This camera is an infrared camera. A type of the sensor carried on the camera was a CMOS sensor, having its resolution degree: 1280×1024, and the number of pixels: 1,300,000 (1.3 million). And, as many as ten cameras were used. These ten cameras were arranged at different positions. The ten cameras were arranged to surround each of the testees performing the swinging motion. The sampled frequency was set to 250 Hz. All of the golf clubs had the markers (mk) provided thereon as shown in FIG. 3.

The swinging motion of each golf club by each testee was determined in order to calculate the contribution ratio of the swinging motion. The equation (1) and the equation (2) were used when the contribution ratio was calculated. And, the virtual swinging plane (PL1) was set by the method as described above, using the least square method. The three-dimensional coordinate was projected onto the virtual swinging plane (PL1), and based on the two-dimensional coordinate obtained by that projection, the power index value (Pw) and the power integration value (Sp) were calculated. As the power integration value (Sp), the integrated value obtained by integrating the values ranging from 0.30 second prior to the impact to this impact was used. The club energy (Eg) was the club energy (Eg) at the impact. This club energy (Eg) was calculated by the equation (fm 1).

Figure 14:
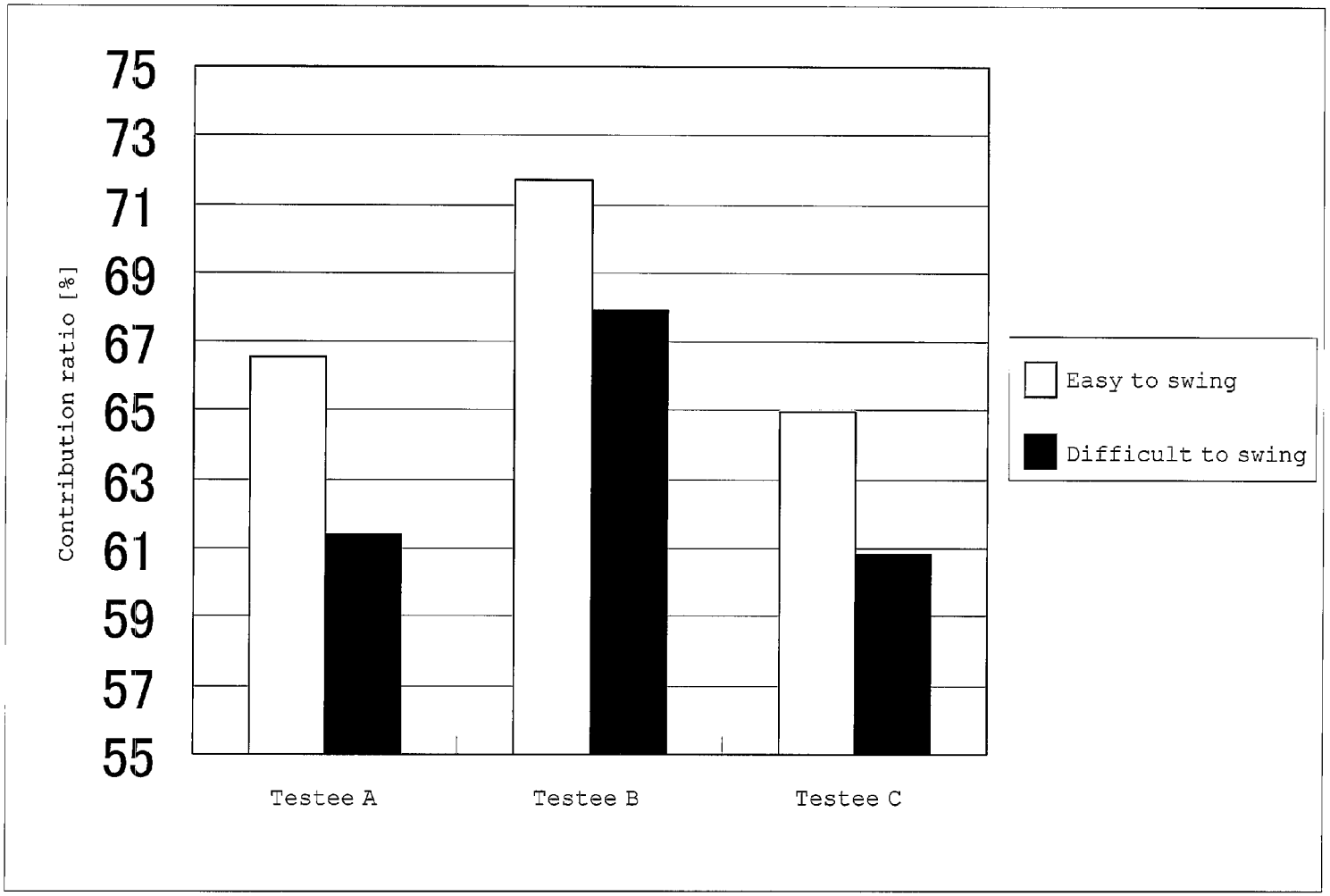
FIG. 14 is a graph showing results of testees according to an example of the present invention.

FIG. 14 shows bar graphs including the contribution ratio (%) when each of the testees swung the golf club which was evaluated as the most difficult to swing, and the contribution ratio (%) when each testee swung the golf club which was evaluated as the easiest to swing. For each of Testee (A), (B) and (C), the bar on the left side indicates the contribution ratio when the testee swung the golf club which was evaluated as the easiest to swing, and the bar on the right side indicates the contribution ratio when each testee swung the golf club which was evaluated as the most difficult to swing. In other words, the uncolored bar indicates the contribution ratio when the testee swung the golf club which was evaluated as the easiest to swing, and the black bar indicates the contribution ratio when each testee swung the golf club which was evaluated as the most difficult to swing. For all of the testees, the contribution ratio when each testee swung the golf club which was evaluated as the easiest to swing was larger than the contribution ratio when each of the testees swung the golf club which was evaluated as the most difficult to swing. The contribution ratio is a quantitative value, and thus this value is easy to compare and analyze. Since the contribution ratio is a quantitative value, that is, since the contribution ratio which is capable of improving the precision of the comparison is a quantitative value, the precision when the result of the evaluation is analyzed can be improved.

The present invention provides the result of the evaluation in a quantitative manner. And, this result of the evaluation has its significance. As appreciated from the description above, the present invention has a conspicuous advantage.

The method as described above has its application to the evaluation of the golf club.

Finally, it is to be noted that the description as above is made only for the illustration purpose. And thus various modifications can be made without departing from the scope and spirit of the present invention.

What is claimed is:

1. A method of evaluating a golf club comprising the steps of:

a step (St1) of using at least one computer for determining motions of the golf club during a swinging motion of a golf player including a period ranging from a time (Ts) to a time (Tf);

a step (St2) of using the at least one computer for obtaining power index values (Pw) in a time series during the period ranging from the time (Ts) to the time (Tf), based on the result of the determination;

a step (St3) of using the at least one computer for obtaining a power integration value (Sp) by integrating the power index values (Pw) during the period ranging from the time (Ts) to the time (Tf);

a step (St4) of using the at least one computer for calculating club energy (Eg) of the golf club at the time (Tf); and a step (St5) of using the at least one computer for quantitatively evaluating club suitability based on the power integration value (Sp) and the club energy (Eg); wherein each of the power index values (Pw) is a value which is correlated to power of a work provided from the golf player to the golf club; and wherein the club suitability is evaluated based on a ratio (Sp/Eg) of the power integration value (Sp) relative to the club energy (Eg).

2. The method according to claim 1, wherein the power index value (Pw) is calculated according to the Equation (1) as below:

$$Pw=M\cdot(\ddot{r}-g)\cdot\dot{r}+Tg\cdot\omega \quad (1)$$

where, in the equation (1), "M" is a weight of the golf club; "$\ddot{r}$" (with two dots appended thereto) is an acceleration of the center of gravity of the golf club; "g" is an acceleration of gravity; "$\dot{r}$" (with one dot appended thereto) is a velocity of the center of gravity of the golf club; "Tg" is a torque acting around a rotation axis (Z1) extending perpendicularly to a virtual swinging plane (PL1) and passing through the golf grip; and "ω" is an angular velocity of the golf grip.

3. The method according to claim 1, wherein the club energy (Eg) is a sum of the values (E1) and (E2) as below:

(E1): kinetic energy of the golf club or an approximate value thereof; and (E2): rotation energy of the golf club or an approximate value thereof.

4. The method according to claim 1, wherein the time (Tf) is a time when the golf club impacts on a golf ball.

5. The method according to claim 1, wherein the time (Ts) is a time when the golf club is positioned adjacent a top-of-the-swing thereof.

6. The method according to claim 1, wherein during the step (St1), the determination is effected with using a motion capturing system.

7. The method according to claim 6, wherein the motion capturing system has a plurality of cameras, a plurality of markers attached to the golf club, and a data analyzing device; and wherein the number of the markers ranges from 3 to 10.

8. The method according to claim 7, wherein the markers are provided to the grip, the head and the shaft; and wherein the golf club includes two markers which are apart from each other at a distance no less than 30 mm.

9. The method according to claim 6, wherein the motion capturing system has a plurality of cameras, a plurality of marks integrally provided with the golf club, and a data analyzing device; and wherein the number of the marks ranges from 3 to 10.

10. The method according to claim 9, wherein the marks are provided to the grip, the head and the shaft; and wherein the golf club includes two marks which are apart from each other at a distance no less than 30 mm.

11. The method according to claim 1, wherein the power index value (Pw) is a sum of values (a) and (b) as below:

(a): a power index value (Pw A) related to a translational motion of the golf club; and (b): a power index value (Pw B) related to a rotational motion of the golf club.

12. The method according to claim 1, wherein during the step (St1), the determination is effected as three-dimensional data; and wherein during the step (St2), the three-dimensional data are converted to use them as two-dimensional data.

13. The method according to claim 1, wherein a three-dimensional determination system is used during the step (St1); and wherein the step (St2) includes a step (St22) in which a posture of a shaft of the golf club is calculated at each of the times, based on a three-dimensional coordinate obtained by the three-dimensional determination system.

14. The method according to claim 1, wherein a three-dimensional determination system is used during the step (SW; and wherein the step (St2) includes a step (St23) in which an acceleration value at a center of gravity of the golf club is calculated at each of the times, based on a three-dimensional coordinate obtained by the three-dimensional determination system.

15. The method according to claim 14, wherein during the step (St23), the acceleration value at the center of gravity of the golf club is calculated based on the three-dimensional coordinate of a grip of the golf club.

16. The method according to claim 14, wherein the step (St2) includes a step (St24) in which a torque (Tg) acting at the grip is calculated based on the calculated acceleration value at center of gravity.

17. The method according to claim 1, wherein when the power index values (Pw) are calculated during the step (St2), an approximate rotation axis of the golf club is set;

wherein the approximate rotation axis is an axis extending perpendicularly to a virtual swinging plane (PL1); and wherein the virtual swinging plane (PL1) is obtained by approximating the data of the swinging motion determined during the step (St1).

* * * * *